US008622210B2

(12) United States Patent
Boland

(10) Patent No.: US 8,622,210 B2
(45) Date of Patent: Jan. 7, 2014

(54) DISPLAY PACKAGE

(75) Inventor: Kevin Patrick Boland, Lakeville, MN (US)

(73) Assignee: Liberty Procurement Co. Inc., Union, NJ (US)

( * ) Notice: Subject to any disclaimer, the term of this patent is extended or adjusted under 35 U.S.C. 154(b) by 322 days.

(21) Appl. No.: 12/945,273

(22) Filed: Nov. 12, 2010

(65) Prior Publication Data

US 2012/0118768 A1 May 17, 2012

(51) Int. Cl.
*B65D 85/00* (2006.01)

(52) U.S. Cl.
USPC ..... 206/320; 206/525.1; 206/701

(58) Field of Classification Search
USPC ..... 206/320, 521.5, 525.1, 525, 701, 702, 206/722, 591, 592, 521, 585, 593, 521.15, 206/728; 229/120.17, 164, 122.1, 120.21, 229/122, 122.3, 117.24, 125.28, 125.32
See application file for complete search history.

(56) References Cited

U.S. PATENT DOCUMENTS

| | | | | |
|---|---|---|---|---|
| 4,099,612 | A * | 7/1978 | Hanson | 206/783 |
| 4,257,211 | A * | 3/1981 | Fales et al. | 53/442 |
| 4,403,727 | A * | 9/1983 | Grieve et al. | 229/120.15 |
| 5,523,934 | A * | 6/1996 | Dworman et al. | 362/431 |
| 5,855,316 | A * | 1/1999 | Spivey | 229/120.14 |
| 6,325,209 | B1 | 12/2001 | Humphrey | |
| D458,842 | S | 6/2002 | Humphrey | |
| RE39,565 | E | 4/2007 | Humphrey | |
| 2002/0125163 | A1 * | 9/2002 | Chou | 206/418 |

* cited by examiner

*Primary Examiner* — Luan K Bui
*Assistant Examiner* — Rafael Ortiz
(74) *Attorney, Agent, or Firm* — Lerner, David, Littenberg, Krumholz & Mentlik, LLP

(57) ABSTRACT

A packaging assembly for displaying and holding a light fixture and an accessory thereof generally includes a bottom base portion and an upper portion. The bottom base portion has an open compartment dimensioned to receive a base of a light fixture. The upper portion is coupled to the bottom base portion and includes a hollow compartment dimensioned to receive an accessory for the light fixture.

11 Claims, 33 Drawing Sheets

DISPLAY PACKAGE

BACKGROUND OF THE INVENTION

The present invention relates to display packages. More particularly, the present disclosure relates to packages for displaying and holding light fixture such as lamps and accessories such as light bulbs.

Some jurisdictions have enacted laws to decrease or at least stabilize electrical energy consumption. Some of these laws require manufacturers to make energy efficient lamps or light fixtures. For example, under California law, manufactures, sellers, and importers of lamps or light fixtures may comply with current energy reduction statutes and regulations by including a compact fluorescent light (CFL) bulb in the product packaging, while still using a standard screw-based socket in the lamp. In light of the foregoing, it is desirable to provide a packaging assembly capable of displaying and holding a light fixture and a light bulb.

BRIEF SUMMARY OF TEE INVENTION

The present disclosure relates to a packaging assembly for displaying and holding a light fixture and an accessory thereof. In one embodiment, the packaging assembly generally includes a bottom base portion and an upper portion. The bottom base portion has an open compartment dimensioned to receive a base of a light fixture. The upper portion is coupled to the bottom base portion and includes a hollow compartment dimensioned to receive an accessory for the light fixture.

In accordance with the above embodiment, the upper portion may include an opening leading to the hollow compartment. This opening is dimensioned to allow at least one of the accessory or a package containing the accessory to be visible from outside of the upper portion. The accessory may comprise a light bulb. The upper portion may include at least two locking tabs protruding toward the opening. The two locking tabs are adapted to inhibit removal of the accessory through the opening. The two locking tabs may protrude toward each other in a common plane. The bottom base portion may include first and second sidewalls oriented substantially parallel to each other, and the open compartment is positioned between the first and second sidewalls. The packaging assembly may further include a cord compartment dimensioned to receive an electrical cord of the light fixture. The cord compartment is disposed between the bottom base portion and the upper portion. The packaging assembly may additionally include a hole leading to the cord compartment and dimensioned to receive at least a portion of the electrical cord. The hole is in communication with the open compartment of the bottom base portion.

The present disclosure further relates in another embodiment to a packaging assembly for displaying and holding a light fixture including a bottom base portion and an electrical cord compartment. The bottom base portion has an open compartment shaped and dimensioned to receive a base of a light fixture. The electrical cord compartment is positioned adjacent the bottom base portion and is dimensioned to receive an electrical cord of the light fixture.

In accordance with the above embodiment, the packaging assembly may further include an upper portion coupled to the bottom base portion. The upper portion may include a hollow compartment and an opening leading to the hollow compartment. The hollow compartment is dimensioned to receive an accessory for the light fixture. The opening is dimensioned to allow at least one of the accessory or a package containing the accessory to be visible from outside of the hollow upper portion.

The present disclosure may further relates in another embodiment to a packaging assembly for displaying and holding a light fixture and an accessory therefor including a bottom base portion, an upper portion, and an electrical cord compartment. The bottom base portion has an open compartment dimensioned to receive a base of a light fixture. The upper portion is coupled to the bottom base portion and includes a hollow compartment and an opening leading to the hollow compartment. The hollow compartment is dimensioned to receive an accessory for the light fixture. The opening is dimensioned to allow at least one of the accessory or a package containing the accessory to be visible from outside of the hollow upper portion. The electrical cord compartment is disposed between the bottom base portion and the upper portion. In addition, the electrical cord compartment is dimensioned to receive an electrical cord of the light fixture. The packaging assembly may further include a hole leading to the electrical cord compartment and in communication with the open compartment of the bottom base portion.

The present disclosure further relates in another embodiment to a package assembly including a light fixture, a bottom base portion, and a upper portion. The light fixture includes a light socket, a base, and a body interconnecting the light socket and the base. The bottom base portion has an open compartment receiving a base of the light fixture. The upper portion is coupled to the bottom base portion and includes a hollow compartment storing a light bulb for the light fixture.

The present disclosure further relates in another embodiment to a plurality of blanks adapted to form a display package for a light fixture. In one embodiment, the plurality of blanks include first blank having a plurality of first panels and a plurality of first fold lines, and a second blank having a plurality of second panels and a plurality of second fold lines. The first and second panels are arranged by folding the first and second panels about appropriate first and second fold lines to form a package. This package includes a bottom base portion having an open compartment dimensioned to receive a base of a light fixture, and an upper portion coupled to the bottom base portion, the upper portion including a hollow compartment dimensioned to receive an accessory for the light fixture.

BRIEF DESCRIPTION OF THE DRAWINGS

Various embodiments of the present invention will now be described with reference to the appended drawings. It is appreciated that these drawings depict only some embodiments of the invention and are therefore not to be considered limiting of its scope.

DETAILED DESCRIPTION

Figure 1:
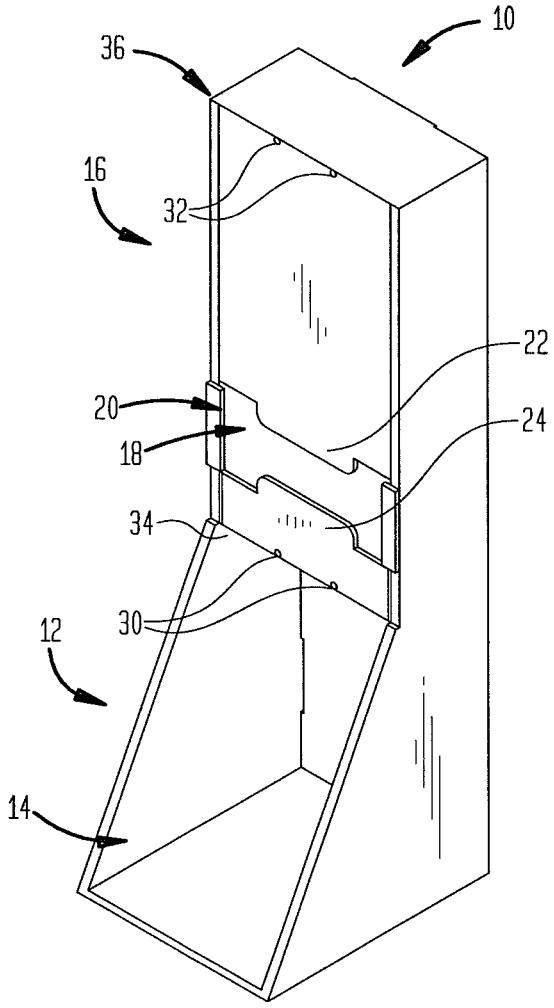
FIG. 1 is an isometric view of display package assembly for holding and displaying a light fixture according to an embodiment of the present disclosure.
Figure 2:
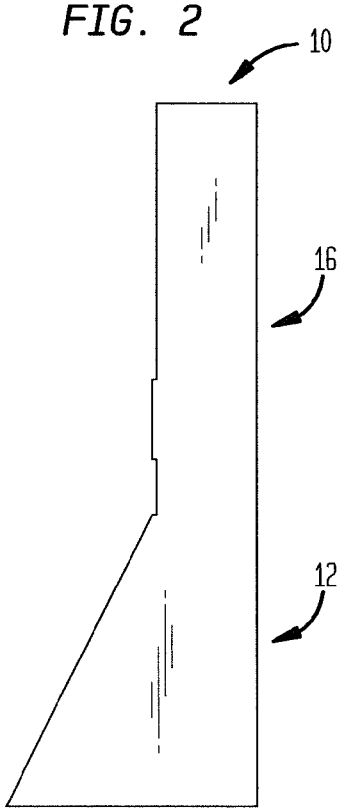
FIG. 2 is a side view of the display package of FIG. 1.
Figure 3:
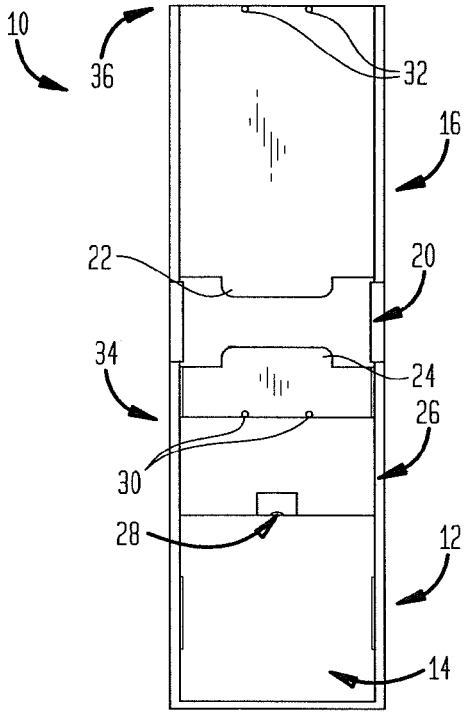
FIG. 3 is a front view of the display package of FIG. 1.
Figure 4:
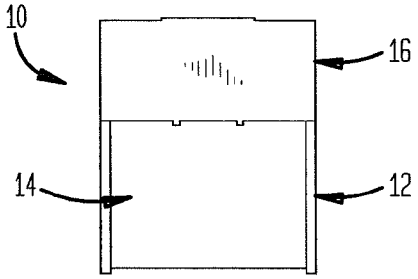
FIG. 4 is a top view of the display package of FIG. 1.

FIGS. 1-4 depict a packaging assembly 10 for displaying and holding any suitable light fixture. Packaging assembly 10 may be used not only during shipping but also for displaying the light fixture in a store. In some embodiments, the packaging assembly 10 includes a bottom base portion 12 having an open compartment 14. The open compartment 14 is shaped and dimensioned to receive the base of any suitable light fixture, such as a lamp.

The packaging assembly 10 further includes a hollow upper portion 16 coupled to the bottom base portion 12. The hollow upper portion 16 includes a hollow compartment 18 dimensioned to receive any accessory for the light fixture. Suitable accessories for the light fixture include, but are not limited to, light bulbs, such as a CFL bulb. The hollow upper portion 16 may additionally include an opening 20 leading to the hollow compartment 18. The opening 20 is dimensioned to allow the accessory for the light fixture or the package containing such accessory to be visible from outside the hollow upper portion 16. In the embodiment depicted in FIGS. 1-4, the opening 20 is located in a lower portion of the hollow upper portion 16 near the bottom base portion 12. However, the opening 20 may be positioned at any suitable location along the height of the hollow upper portion 16.

The hollow upper portion 16 may additionally include one or more locking tabs 22, 24 near the opening 20 for inhibiting removal of the accessory through the opening 20. In one specific embodiment, the hollow upper portion 16 may include two locking tabs 22 and 24 protruding toward each other and disposed over the opening 20 in a common plane. While the drawings show only two locking tabs 22 and 24, the hollow upper portion 16 may include fewer or more locking tabs.

The hollow upper portion 16 may include a pair of spaced apart apertures 30 at or near its lower end 34 and another pair of spaced apart apertures 32 at or near its upper end 36. Each aperture 30 and 32 is dimensioned to receive a cable tie or any other elongated structure capable of holding a light fixture.

The packaging assembly 10 may also include a hollow cord compartment 26 disposed between the hollow upper portion 16 and the bottom base portion 12. The cord compartment 26 is dimensioned to receive an electrical cord of the light fixture. The packaging assembly 10 may include a hole 28 leading to the cord compartment 26 and in communication with the open compartment 14 of the bottom base portion 12.

Figure 5:
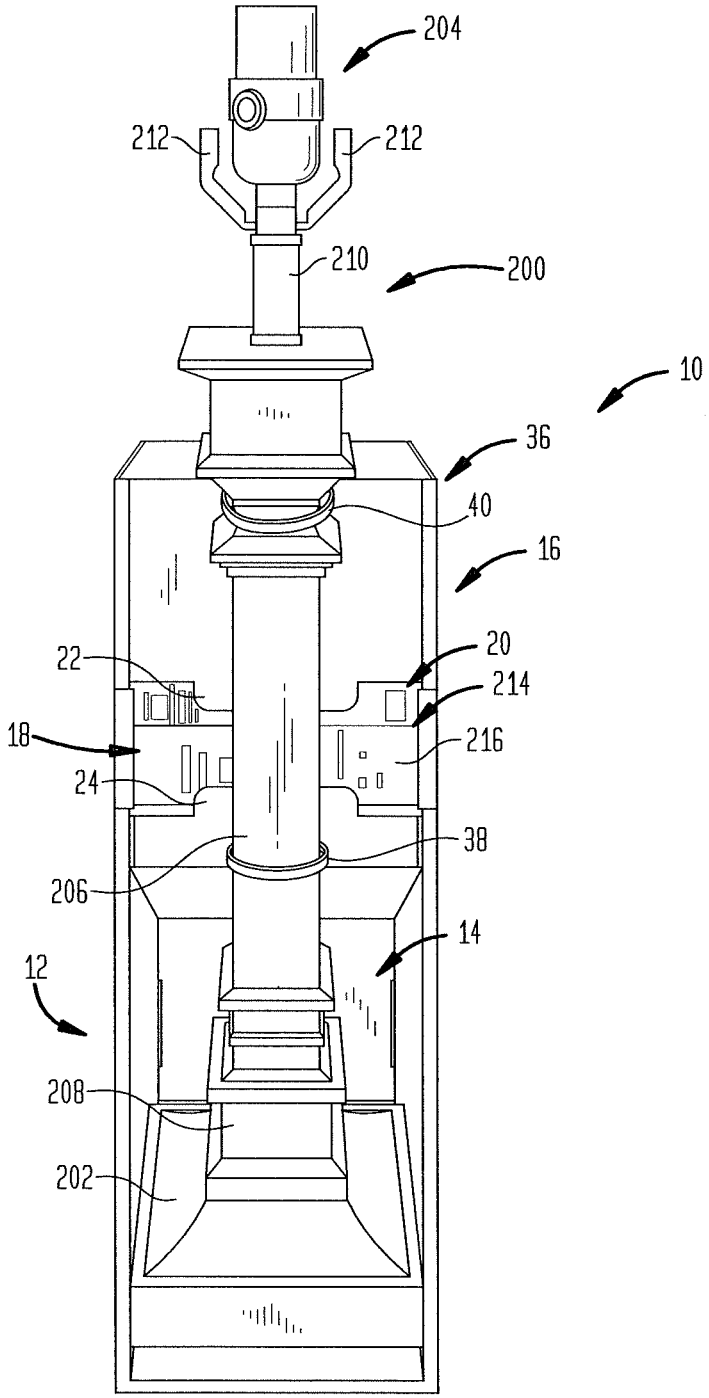
FIG. 5 is a front view of a light fixture positioned in the packaging assembly of FIG. 1.
Figure 6:
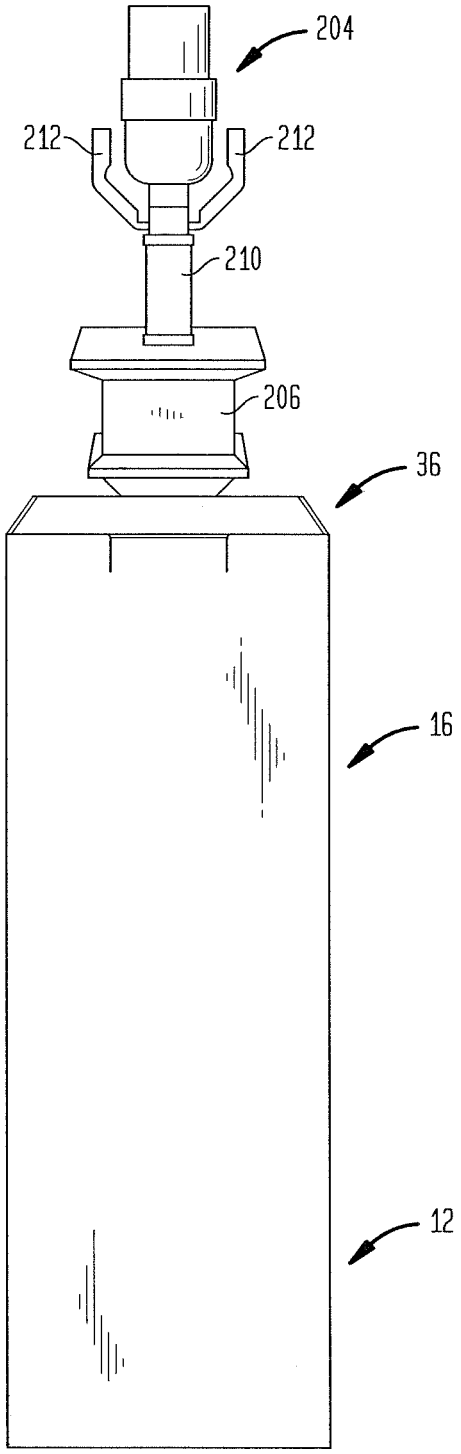
FIG. 6 is a rear view of the light fixture positioned in the packaging assembly of FIG. 1.
Figure 7:
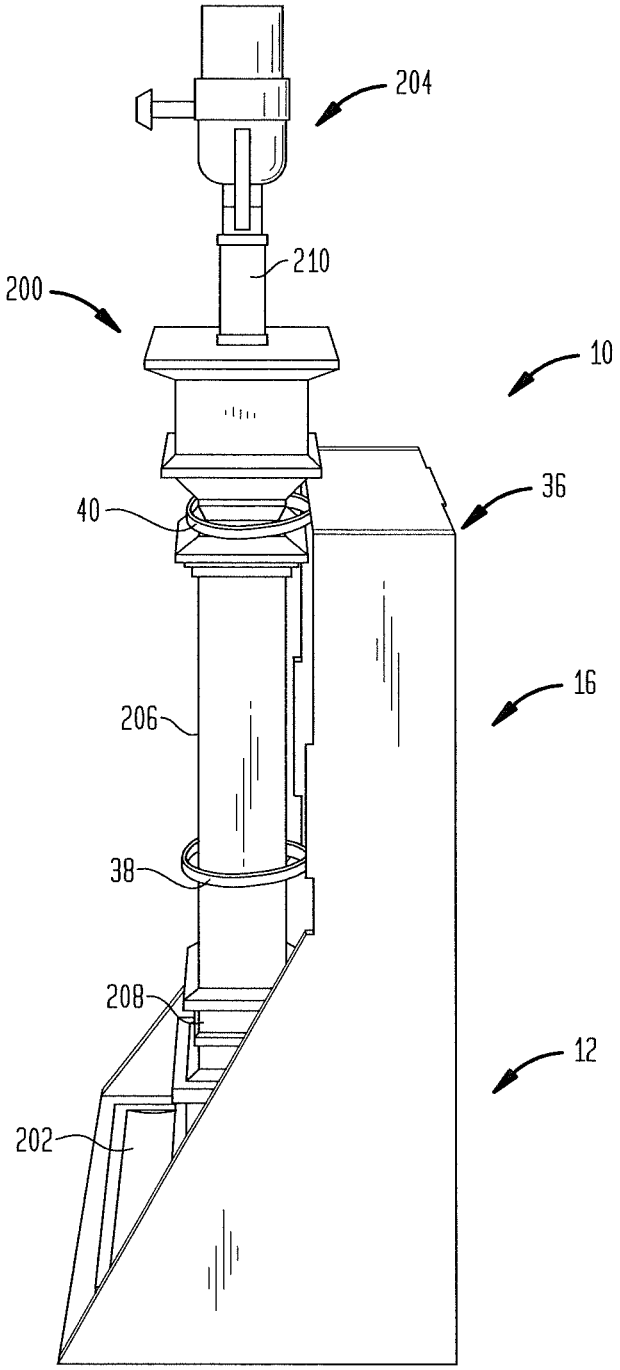
FIG. 7 is a side view of the light fixture positioned in the packaging assembly of FIG. 1.

FIGS. 5-7 show the packaging assembly 10 supporting a light fixture 200. Light fixture 200 generally includes a base 202, a light socket 204 and a body 206 interconnecting the base 202 and the light socket 204. The base 202 of light fixture 200 includes a bottom surface, which may have a substantially planar configuration. Regardless of its configuration, the base 202 of the light fixture 200 is partly or entirely disposed within the open compartment 14 of the bottom base portion 12 of the packaging assembly 10. The lower end 208 of the body 206 is connected to the base 202, whereas the upper end 210 of the body 206 is connected to the light socket 204. At least a portion of the body 206 may abut or contact the hollow upper portion 16 of the packaging assembly 10. An upper portion of the body 206, however, may extend beyond the upper end 36 of the hollow upper portion 16. In such embodiments, a shade (not shown) can be attached to the light fixture 200 while the light fixture is still disposed in the package assembly 10. The light fixture 200 may include one or more attachment members 212 at or near the upper end 210 of the body 206 to allow a shade to be secured to the light fixture 200. The attachment members 212 may be hooks or any other device, mechanism, or means suitable for securely receiving a shade. The attachment members 212 may alternatively be connected to the light socket 204. The light socket 204 of the light fixture 200 may be adapted to securely receive any suitable light bulb, such as a CFL bulb.

With continued reference to FIGS. 5-7, the packaging assembly 10 may further include a first cable tie 38 passing through the pair of apertures 30 and a second cable tie 40 passing through the pair of spaced apart apertures 32. A portion of the first cable tie 38 is disposed within cord compartment 26 and another portion of the first cable tie 38 is wrapped around a portion of the body 206 of the light fixture 200. A portion of the second cable tie 40 is disposed within the hollow compartment 18 of the hollow upper portion 16 and another portion of the second cable tie 40 is securely wrapped around a portion of the body 20 of the light fixture 200.

As seen in FIG. 5, the accessory 214 for the light fixture 200, such as a light bulb, may be positioned inside the hollow compartment 18 of the hollow upper portion 16. The accessory 214 may be partly or entirely enclosed in any suitable package 216, such as a box. In such case, the opening 20 of the hollow upper portion 16 allows the accessory 214 or the package 216 to be visible from outside of the packaging assembly 10. Moreover, the locking tabs 22 and may be disposed over the package 216, thereby hindering removal of the accessory 214.

Figure 8:
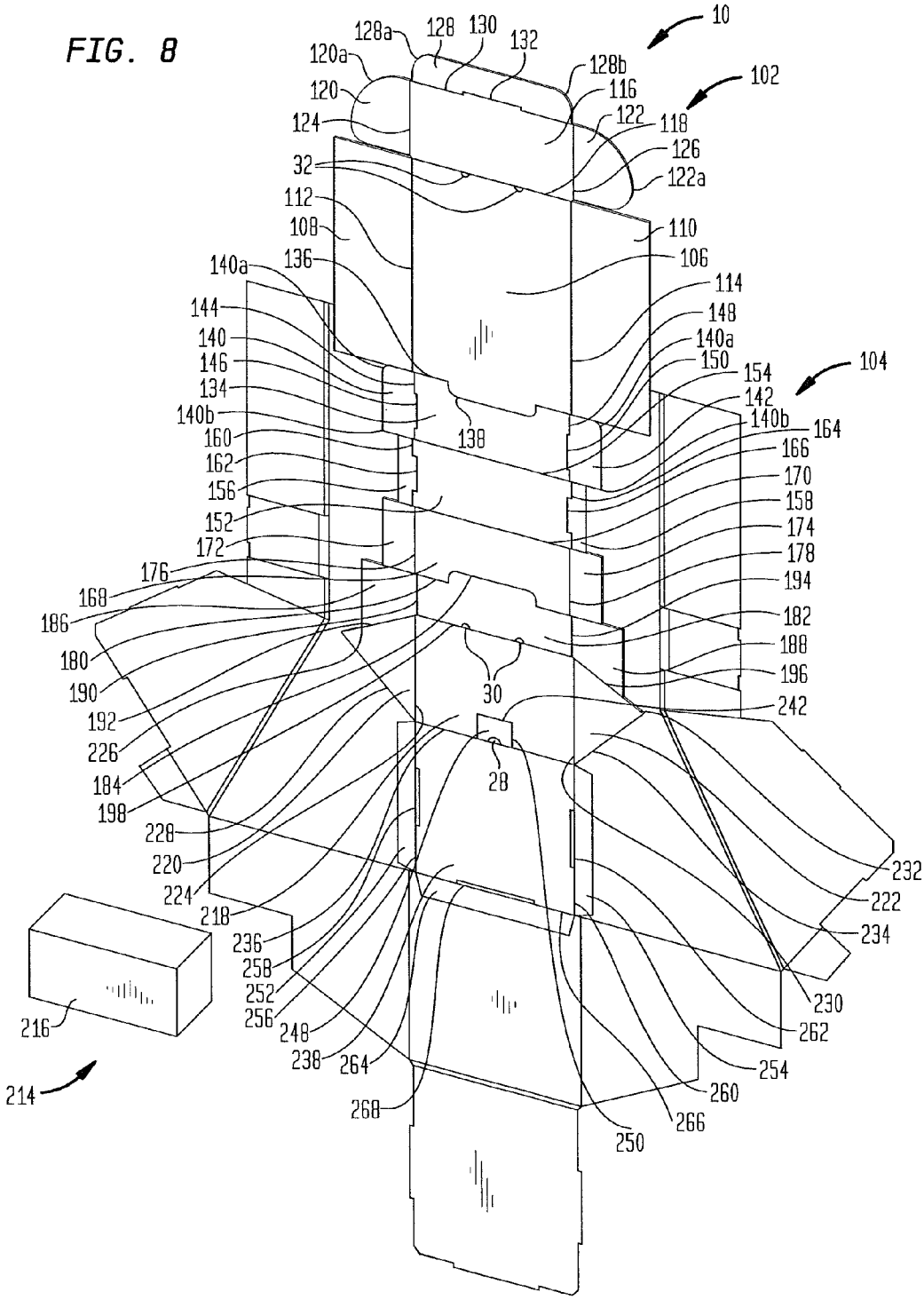
FIG. 8 is an isometric view of a plurality of blanks adapted to form the packaging assembly of FIG. 1, illustrating an initial stage of assembly process.

FIGS. 8-35 illustrate the process of forming packaging assembly 10. In particular, FIG. 8 illustrates the first stage of the assembly process of packaging assembly 10. Initially, the packaging assembly 10 is arranged in an unfolded condition and includes at least two discrete blanks, namely, a first blank 102 and second blank 104. These blanks 102, 104 may be formed from various materials such as stiff boards, cardboards, plastic and the like. First and second blanks 102 and 104 are adapted to be folded to form packaging assembly 10, as shown in FIG. 1.

First blank 102 includes a main central panel 106 disposed between a side panels 108 and 110. Main central panel 106, side panel 108, and side panel 110 may have a substantially rectangular shape. However, main central panel 106 may be larger than side panels 108 and 110. A fold line 112 divides the main central panel 106 and side panel 108. A fold line 114 divides side panel 110 and main central panel 106.

A panel 116 is foldably attached to a top portion of main central panel 106 along a fold line 118 and may have a substantially rectangular shape. The pair of apertures 32 may be disposed along fold line 118. Two tabs 120 and 122 are disposed on opposite sides of panel 116. Each of tabs 120 and 122 may have a rounded end 120*a*, 122*a*, respectively. A fold line 124 divides panel 116 and tab 120. A fold line 126 divides panel 116 and flap 122.

A tab 128 is attached to the top portion of panel 116 and may include rounded corners 128*a*, 128*b*. A fold line 130 divides panel 116 and tab 128. A cutout 132 is disposed along fold line 130.

A panel 134 is attached to the bottom portion of main central panel 106 and may have a substantially rectangular shape. A fold line 136 divides main central panel 106 and panel 134. A cutout 138 is disposed along fold line 136 and between main central panel 106 and panel 134. Two flaps 140 and 142 are attached to opposite sides of panel 134. A fold line 144 divides flap 140 and panel 134. A cutout 146 may be disposed along fold line 144 and between panel 134 and flap 140. Flap 140 may have an upper rounded corner 140*a* and a lower square corner 140*b*. Flap 142 may also have an upper rounded corner 142*a* and a lower square corner 142*b*. A fold line 148 divides flap 142 and panel 134. A cutout 150 is disposed along fold line 148 and between panel 134 and flap 142.

A panel 152 is attached to a bottom portion of panel 134. Fold line 154 divides panel 134 and panel 152. Two flaps 156 and 158 are attached to opposite sides of panel 152. A fold line 160 divides panel 152 and flap 156. A cutout 162 is disposed along fold line 160 and between panel 152 and flap 160. A fold line 164 divides panel 152 and flap 158. A cutout 166 is disposed along fold line 164 and between panel 152 and flap 158.

A panel 168 is attached to a bottom portion of panel 152. A fold line 170 divides panel 168 and panel 152. Two flaps 172 and 174 are attached to opposite sides of panel 168. A fold line 176 divides flap 172 and panel 168. A fold line 178 divides flap 174 and panel 168. Each of flaps 172 and 174 may have a substantially rectangular shape.

A panel 182 is attached to a bottom portion of panel 168. A fold line 180 divides panel 182 and panel 168. A cutout 184 is disposed along the fold line 180 and between panel 182 and 168. Two flaps 186 and 188 are attached to opposite sides of the panel 182. A fold line 190 divides panel 182 and flap 186. Flap 186 includes a lower edge 192 oriented at an oblique angle relative to fold line 190. A fold line 194 divides flap 188 and panel 186. Flap 188 includes a lower edge 196 oriented at an oblique angle relative to fold line 194.

The pair of spaced apart apertures 30 may be disposed at, near or along a fold line 198. Fold line 198 is positioned adjacent a lower portion of panel 182 and divides panel 218 and panel 182. Two flaps 220 and 222 are attached to opposite sides of panel 218.

A fold line 224 divides flap 220 and panel 218. Flap 220 may have a substantially triangular shape and includes an upper edge 226 and a lower edge 228. The upper edge 226 of flap 220 may be oriented at an oblique angle relative to fold line 224. The oblique angle defined by upper edge 226 is complementary to the oblique angle defined by the lower edge 192 of flap 186. The lower edge 228 of flap 220 is oriented at an oblique angle relative to fold line 224.

Flap 222 may also have a substantially triangular shape. A fold line 230 divides flap 222 and panel 218. The upper edge 232 of flap 222 is oriented at an oblique angle relative to fold line 230 The oblique angle defined by the upper edge 232 of flap 222 is complementary to the oblique angle defined by the lower edge 196 of flap 188. The lower edge 234 of flap 222 may also be oriented at an oblique angle relative to fold line 230.

A fold line 242 divides panel 218 and a flap 248 positioned adjacent a lower portion of panel 218. Flap 248 is formed by a substantially rectangular or square cutout 250. The lower edge of flap 248 may include aperture 28, which is dimensioned to receive an electrical cord of light fixture 200.

A fold line 236 is disposed adjacent to flap 248 and divides panel 218 and panel 238. Two flaps 252 and 254 are attached to opposite sides of panel 238. A fold line 256 divides flap 252 and panel 238. A cutout 258 is disposed along fold line 256 between panel 238 and flap 252. A fold line 260 divides panel 238 and flap 254. A cutout 262 is disposed along fold line 260 and between panel 238 and flap 254.

A flap 264 is attached to a bottom portion of panel 238. A fold line 266 divides panel 238 and flap 264. A cutout 268 is disposed along fold line 266.

Figure 9:
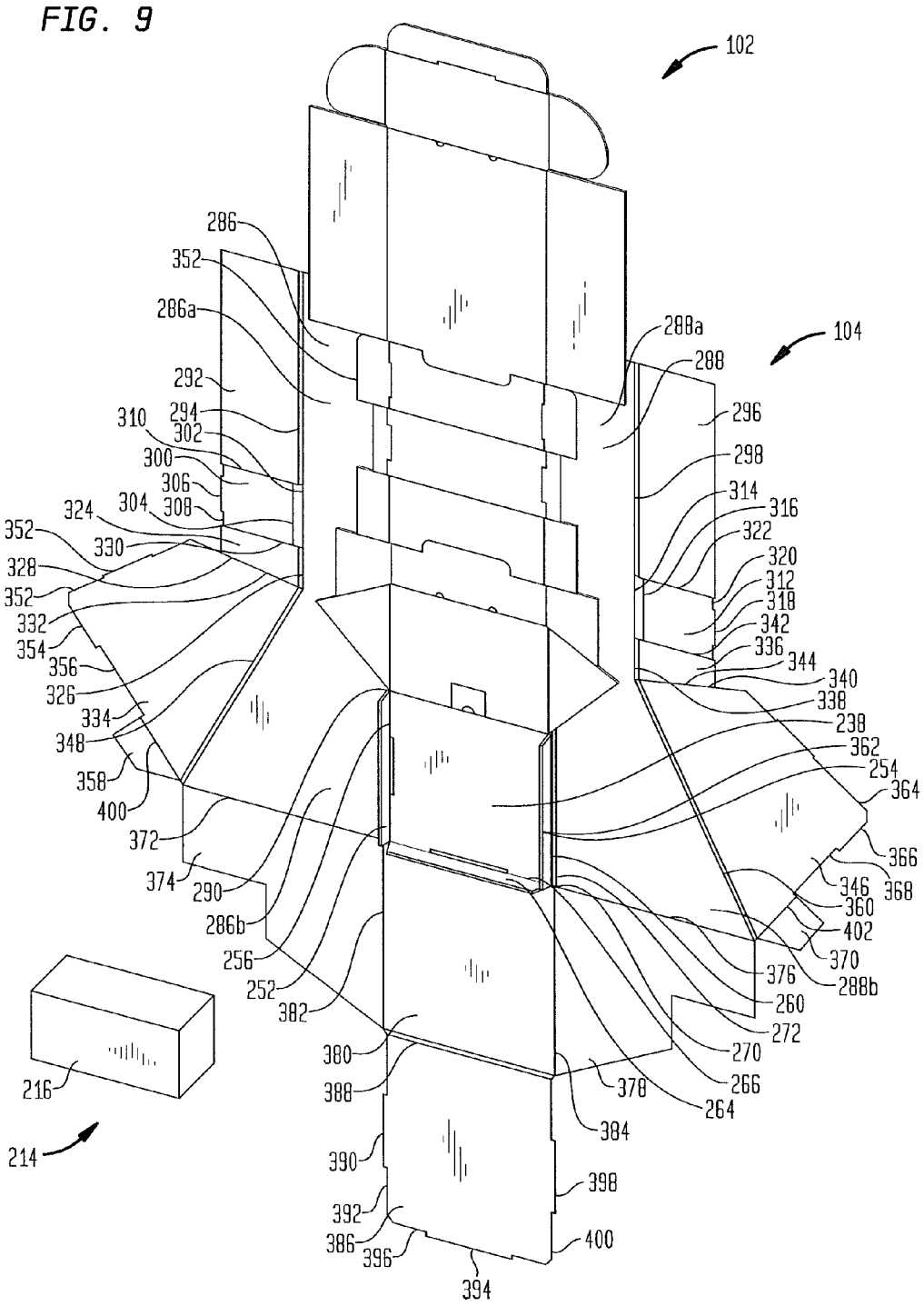
FIGS. 9-35 are isometric views of a plurality of blanks shown in FIG. 8, illustrating the steps for forming the packaging assembly of FIG. 1.
Figure 29:
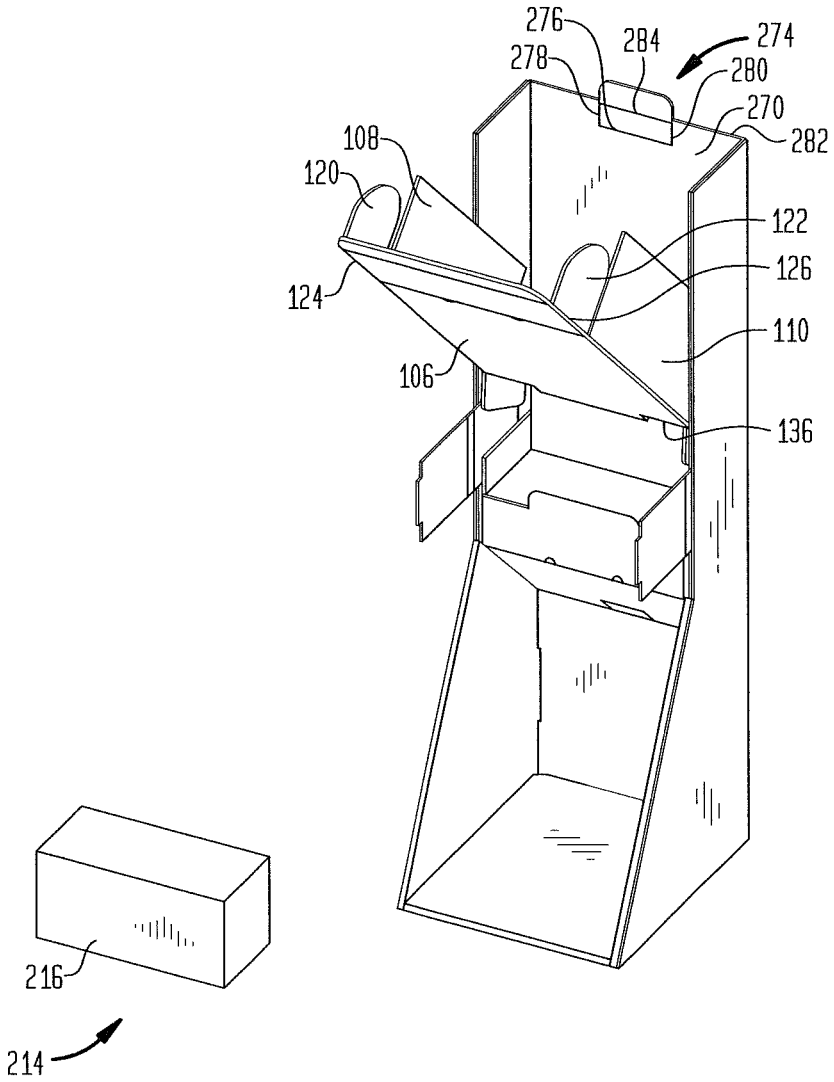

In the interest of clarity, the elements and/or components of second blank 104 will be described in relation to FIGS. 9 and 29. As seen in FIGS. 9 and 29, second blank 104 includes a main central panel 270, which is initially positioned behind the first blank 102. Main central panel 270 may have a substantially rectangular shape.

As seen in FIG. 29, a tab 274 is attached to an upper portion of main central panel 270. A fold line 276 divides and main central panel 270. Two cutouts 278 and 280 disposed on opposite sides of tab 274 physically divide the main central panel 270 and tab 274. Tab 274 may extend beyond the upper edge 282 of main central panel 270 and may include a fold line 284. Accordingly, tab 274 may be folded along fold line 284. Fold line 284 may be axially aligned with the upper edge 282 of main central panel 270. Tab 120 is also folded along fold line 124 until tab 120 is substantially parallel to panel 108. Tab 122 is folded along fold line 126 until tab 122 is substantially parallel to panel 110.

Returning to FIG. 9, two side panels 286 and 288 are attached to opposite sides of main central panel 270. A fold line 290 divides side panel 286 and main central panel 270. Side panel 286 includes an upper portion 286*a* having a substantially rectangular shape and a lower portion 286*b* having a substantially triangular shape. A fold line 272 divides side panel 288 and main central panel 270. Side panel 288 has an upper portion 288*a* having a substantially rectangular shape and a lower portion 288*b* having a substantially triangular shape.

A panel 292 is attached to the upper portion 286*a* of side panel 286. A thick fold line 294 divides side panel 286 and panel 292. A panel 296 is attached to the upper portion 288*a* of the side panel 288. A thick fold line 298 divides side panel 288 and panel 296.

A panel 300 is attached to the upper portion 286*a* of side panel 286. A fold line 302 divides panel 286 and panel 300. Panel 300 may include a fold line 304 adjacent to fold line 302 and a tab 306 protruding from its free end 308. A cutout 310 separates panel 300 and panel 292.

A panel 312 is attached to the upper portion 288*a* of the panel 288. A fold line 314 divides panel 288 and panel 312. Panel 312 may include a fold line 316 adjacent to fold line 314 and a tab 318 protruding from its free end 320. A cutout 322 separates panel 296 and panel 312.

A panel 324 is also attached to the upper portion 286*a* of the side panel 286. A thick fold line 326 divides panel 286 and panel 324. The lower edge 328 of panel 324 may be oriented at an oblique angle relative to thick fold line 326. A cutout 330 separates panel 324 and panel 300. Another cutout 332 adjacent to lower edge 328 separates panel 324 and a panel 334.

A panel 336 is attached to the upper portion 288*a* of side panel 288. A thick fold line 338 divides panel 336 and panel 288. The lower edge 340 of panel 336 is oriented at an oblique angle relative to fold line 338. A cutout 342 separates panel 336 from panel 296. Another cutout 344 separates panel 336 from a panel 346.

Panel 334 is attached to the lower portion 286*b* of side panel 288. A thick fold line 348 divides panel 288 and panel 334. Panel 344 may include a first tab 350 extending from a first free edge 352 and a second tab 354 extending from a second free edge 356. A flap 358 protrudes from the second free edge 356.

Panel 346 is attached to the lower portion 288*b* of the side panel 288. A thick fold line 360 divides panel 288 and panel 346. Panel 346 may include a first tab 362 extending from a first free edge 364 and a second tab 366 extending from a second free edge 368. A flap 370 protrudes from the second free edge 370.

Although not explicitly show in the drawings, a fold line divides main central panel 270 and a panel 380, which may be substantially rectangular. Two panels 374 and 378 are attached to opposite sides of panel 380. A fold line 382 divides panel 380 and panel 374. A fold line 384 divides panel 380 and panel 378. A cutout 372 separates panel 286 and panel 374. Another cutout 376 separates panel 378 and panel 288.

A panel 386 is attached to a lower portion of panel 380. A thick fold line 388 divides panel 380 and panel 386. Panel 386 may include a first tab 390 protruding from its first free edge 392, a second tab 394 protruding from its second free edge 396, and a third tab 398 protruding from its third free edge 400.

Packaging assembly 10 may be assembled following the steps illustrated in FIGS. 8-35. Initially, the first blank 102 is positioned in front and over the second blank 104 as illustrated in FIG. 8. Specifically, panels 134, 152, 168, 182, 218 and at least a portion of panel 106 of first blank are placed over main central panel 270 of second blank 104, as shown in FIG. 8. Panels 134, 152, 168, 182, 218 and 106 of first blank 102 may be oriented substantially parallel to the main central panel 270 of second blank 104.

As seen in FIG. 9, the flap 252 is folded along fold line 256 toward panel 238 until flap 252 is oriented substantially orthogonal to panel 238. Similarly, flap 264 is folded along fold line 266 toward panel 238 until flap 264 is oriented substantially orthogonal to panel 238. In addition, flap 254 is folded along fold line 260 toward panel 238 until flap 254 is oriented substantially orthogonal to panel 238.

Figure 10:
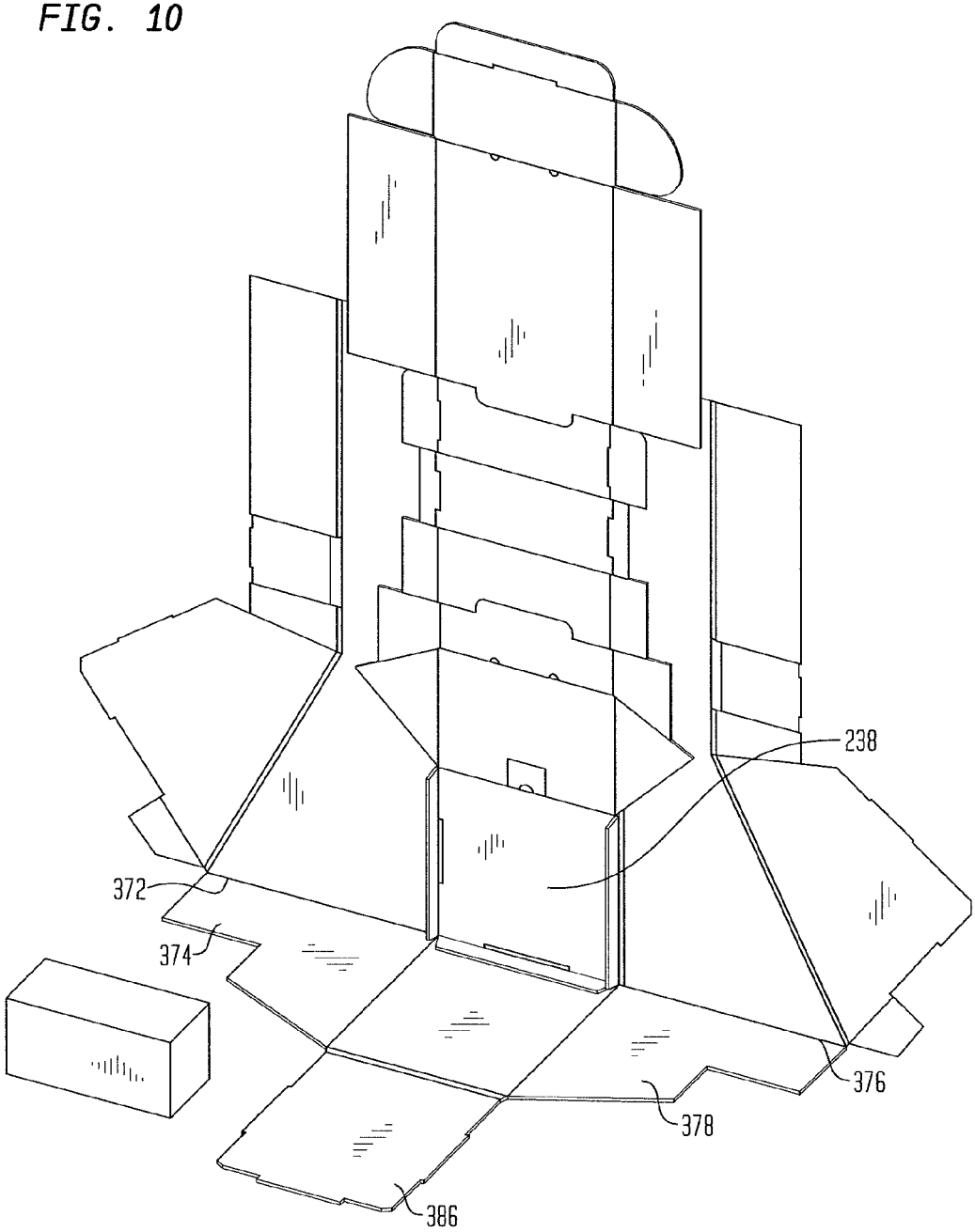

With reference to FIG. 10, panels 374 and 378 are folded along fold lines 372, 376, respectively, toward panel 238 until panels 374 and 378 are oriented substantially orthogonal to panel 238. At this point, panels 380 and 386 should also be oriented substantially orthogonal to panel 238. Panels 380 and 386 will eventually form a bottom wall of the bottom base portion 12.

Figure 11:
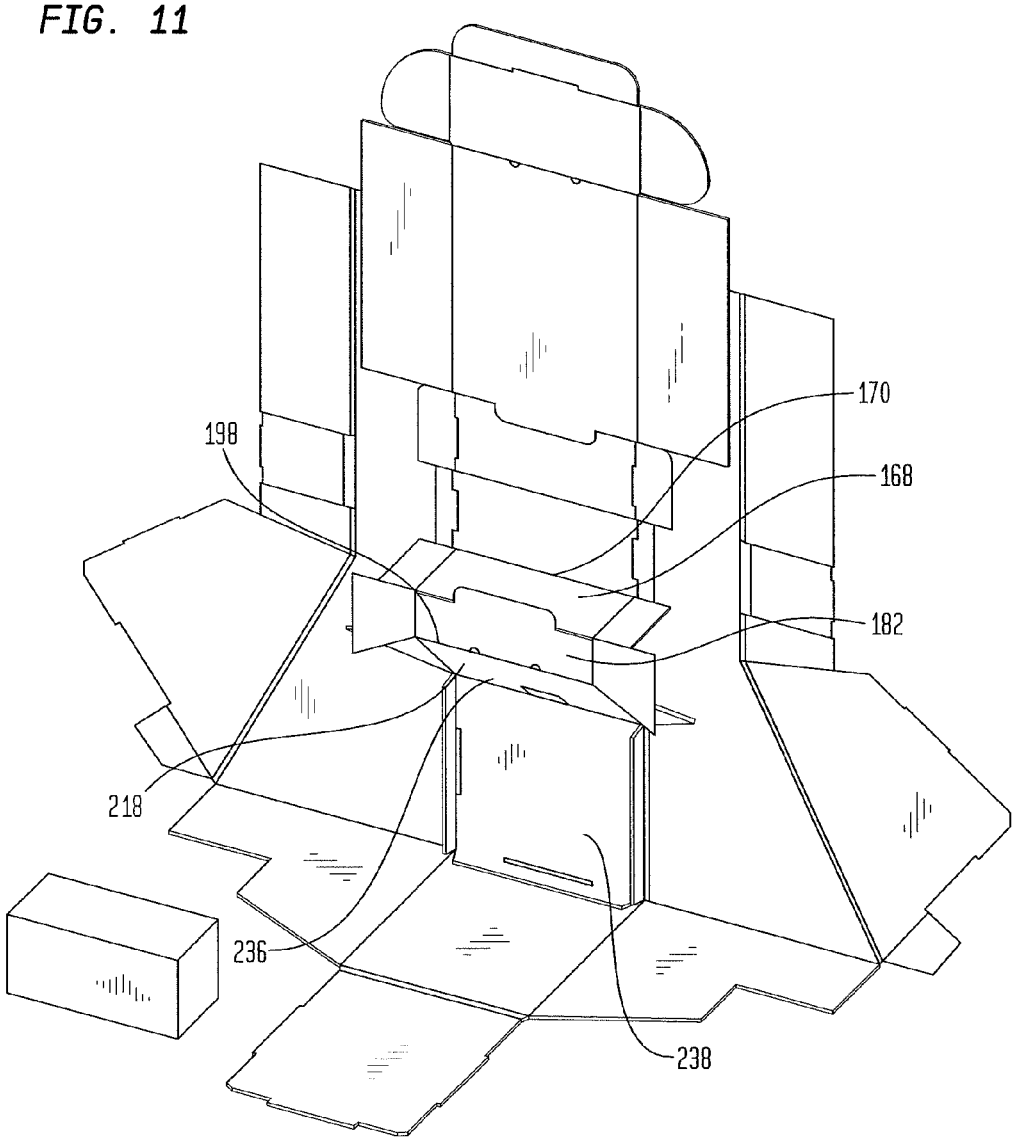

Referring to FIG. 11, panel 182 is moved downwardly toward panel 238. As panel 182 is moved downwardly, it is folded along fold line 198. Panel 182 should be moved downwardly until it is oriented substantially parallel to panel 238. While panel 182 is moved downwardly, panel 218 is folded along fold line 236. At this point, panel 218 is oriented at an oblique angle relative to panels 182 and 238 to form an outer wall of cord compartment 26. The downward movement of panel 182 also causes the panel 168 to be folded along fold line 170 to form the bottom end of hollow compartment 18. Panel 182 should be moved downwardly until panel 168 is oriented substantially orthogonal to panel 238.

Figure 12:
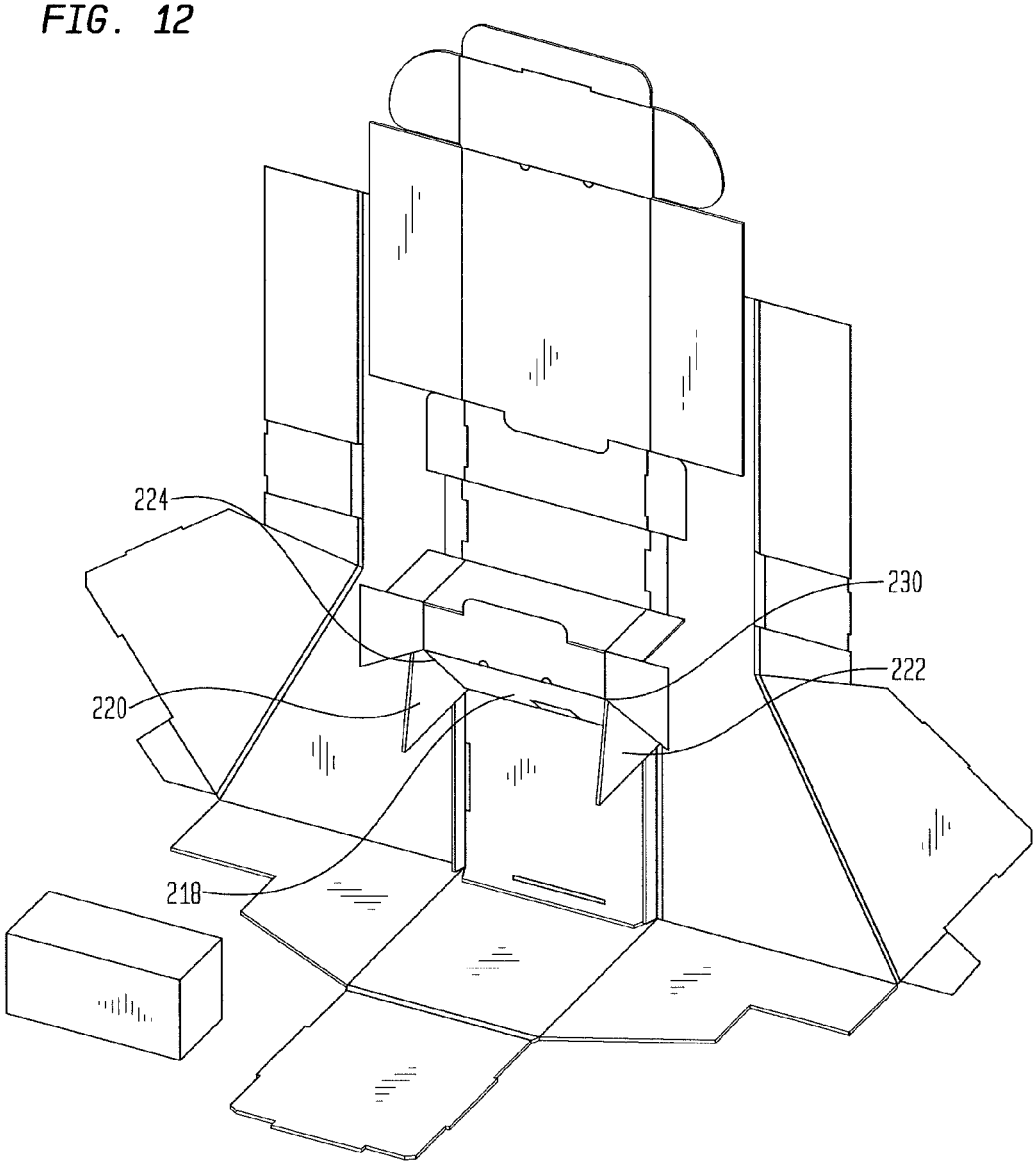

With reference to FIG. 12, flap 220 is folded along fold line 224 toward panel 218 until flap 200 is oriented substantially orthogonal to panel 218. Similarly, flap 222 is folded along fold line 230 toward panel 218 until flap 222 is oriented substantially orthogonal to panel 218.

Figure 13:
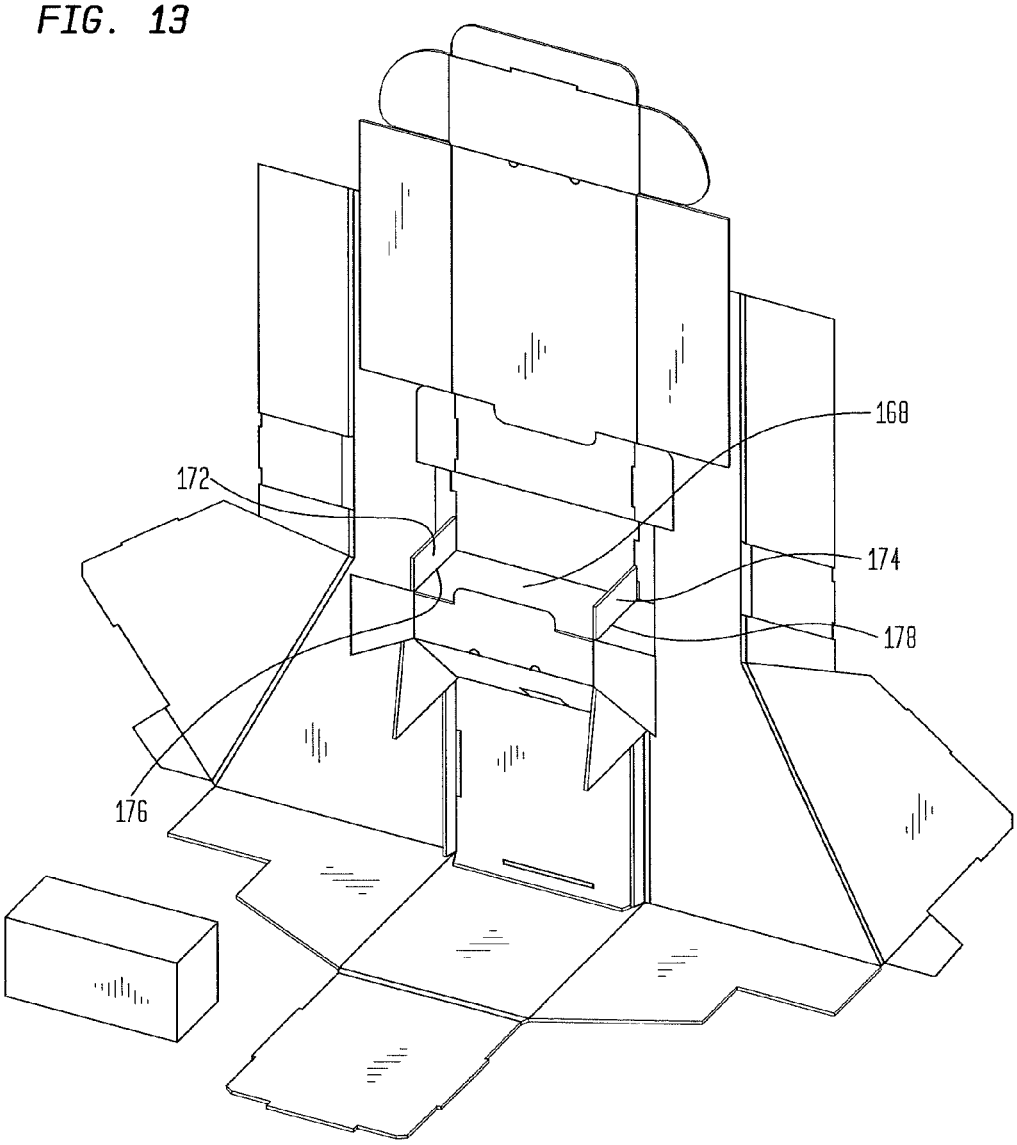

As shown in FIG. 13, flap 172 is folded along fold line 176 toward panel 168 until flap 172 is oriented substantially orthogonal to panel 168. Moreover, flap 174 is folded along fold line 178 toward panel 168 until flap 174 is oriented substantially orthogonal to panel 168. Flap 172 and 174 then form sidewalls extending along a portion of hollow compartment 18.

Figure 14:
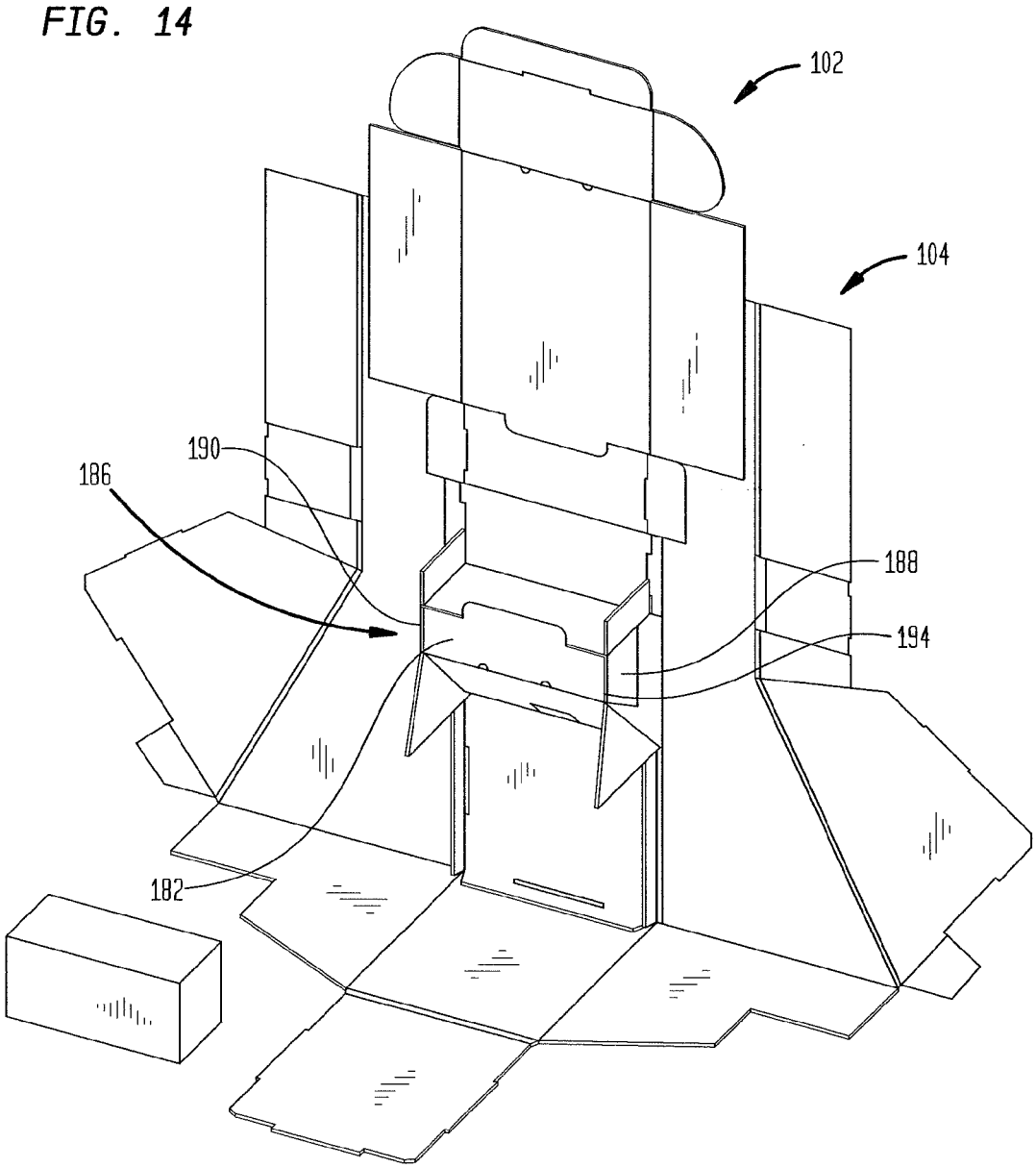

With reference to FIG. 14, flap 186 is folded along fold line 190 toward the second blank 104 until the flap 186 is oriented substantially orthogonal to panel 182 to form a sidewall of cord compartment 26. Flap 188 is folded along fold line 194 toward the second blank 104 until flap 188 is oriented substantially orthogonal to panel 182 to form a sidewall of cord compartment 26.

Figure 15:
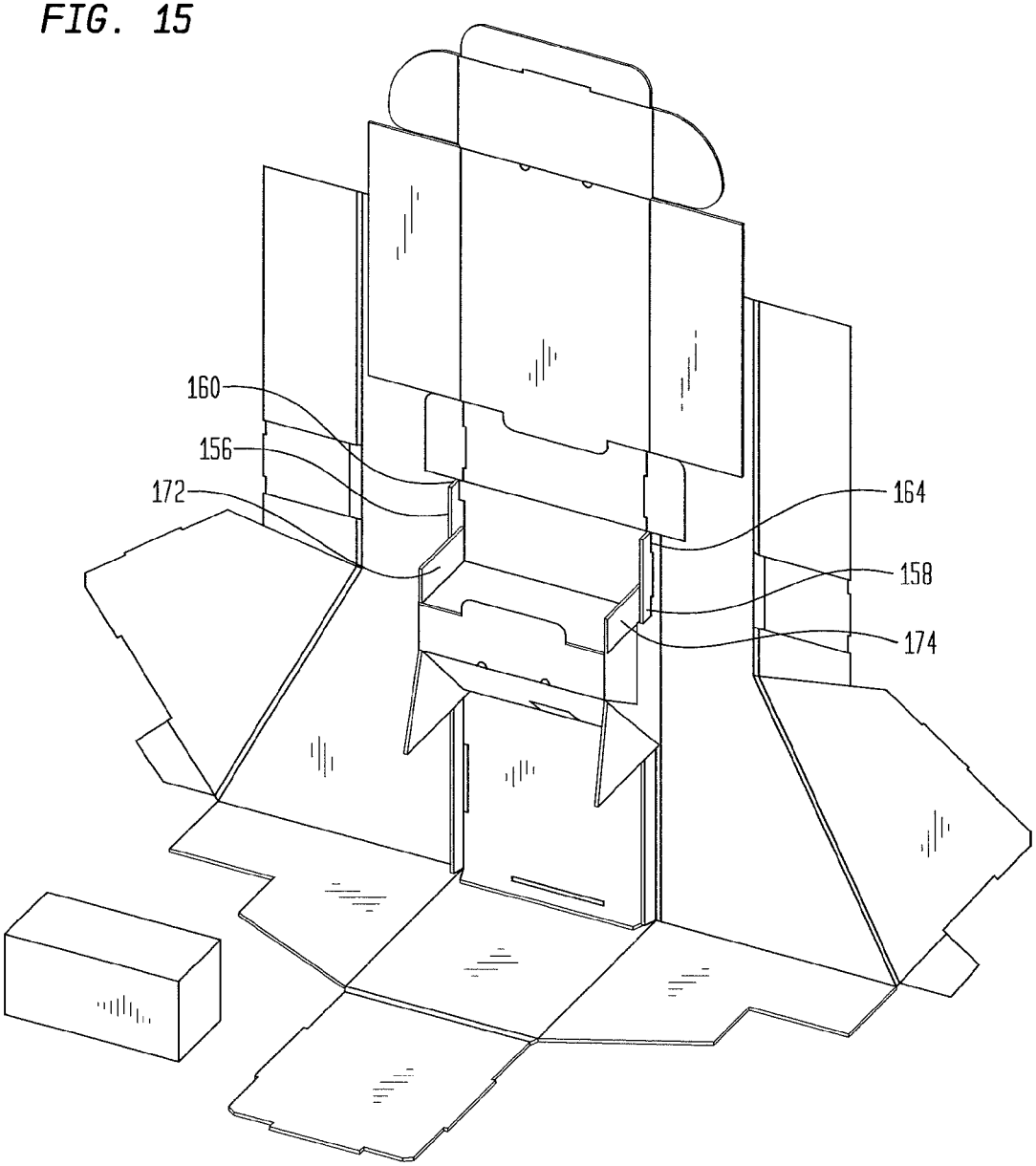

Referring to FIG. 15, flap 156 is folded along fold line 160 toward flap 172 until flap 156 is disposed over flap 172. Flap 158 is folded along fold line 164 toward flap 174 until flap 158 is disposed over flap 174.

Figure 16:
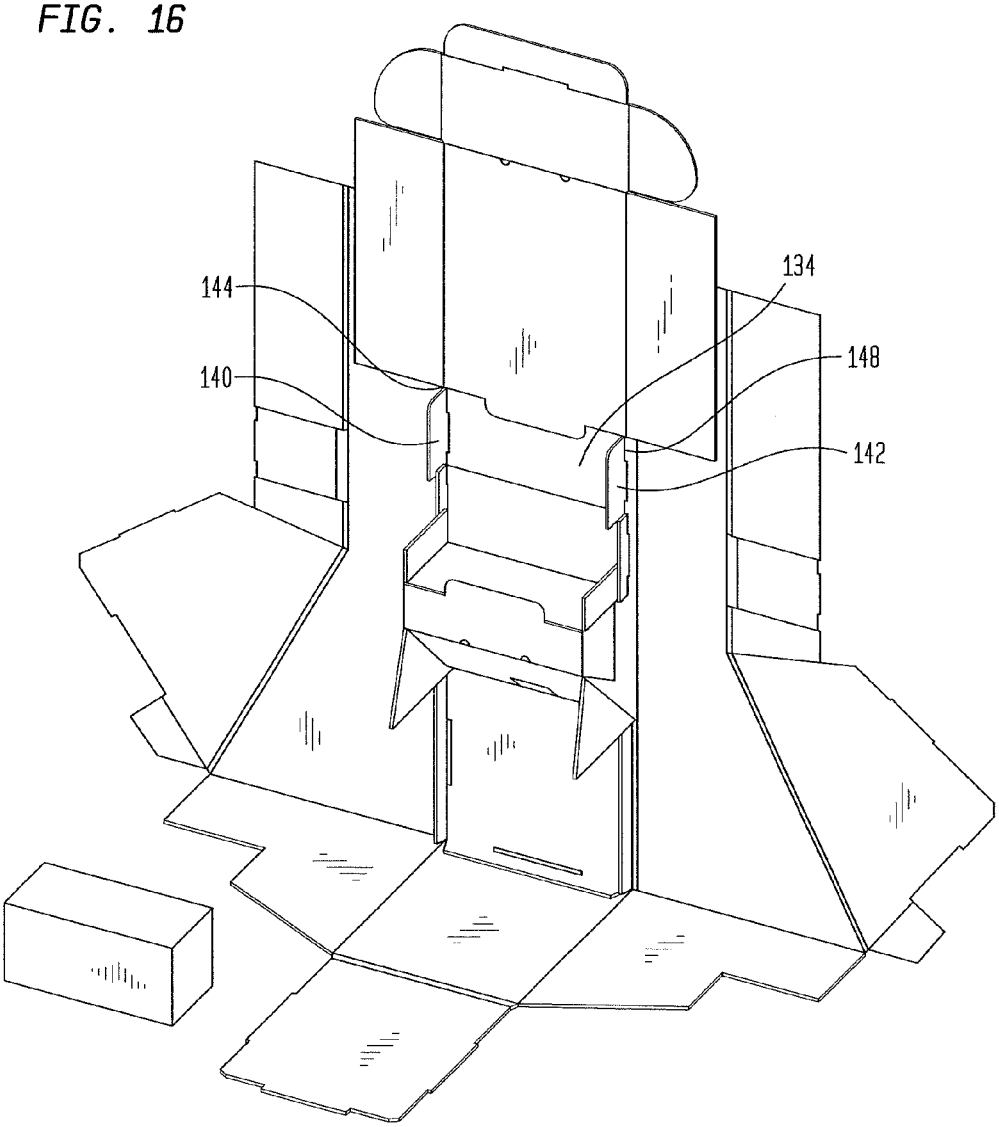

As seen in FIG. 16, flap 140 is folded along fold line 144 toward panel 134 until flap 140 is oriented substantially orthogonal to panel 134. Flap 142 is folded along fold line 148 toward panel 134 until flap 142 is oriented substantially orthogonal to panel 134.

Figure 17:
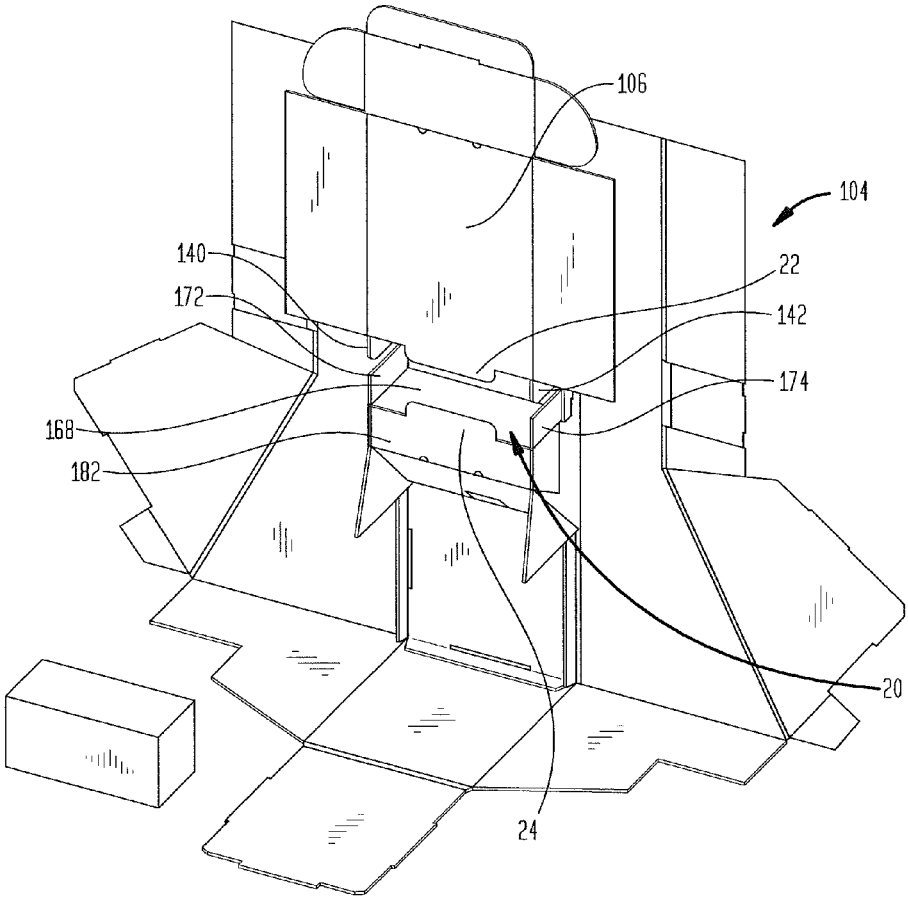

With reference to FIG. 17, main central panel 106 is moved away from second blank 104 and downwardly toward panel 168 to form opening 20. At this juncture, flap 140 is oriented substantially parallel to flap 172. Also, flap 142 is oriented substantially parallel to flap 174. At this junction, opening 20 is formed and locking tabs 20 and 22 are positioned over opening 20. Tab 20 protrudes toward opening 20 from panel 106, whereas tab 22 protrudes toward opening 20 from panel 182. Tabs 20 and 22 may protrude toward each other along a common plane.

Figure 18:
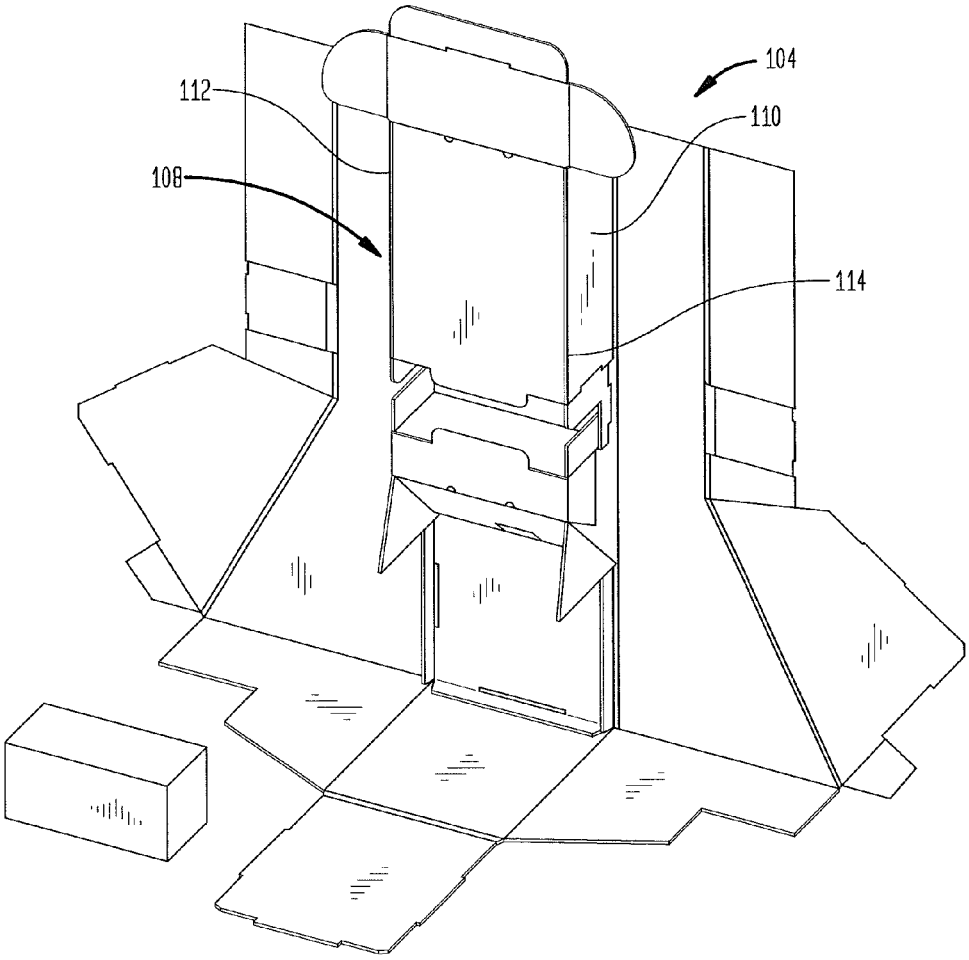

As shown in FIG. 18, panel 108 is folded along fold line 112 toward second blank 104. Similarly, panel 110 is folded along fold line 114 toward second blank 104 to partially form the sidewalls of the hollow compartment 18.

Figure 19:
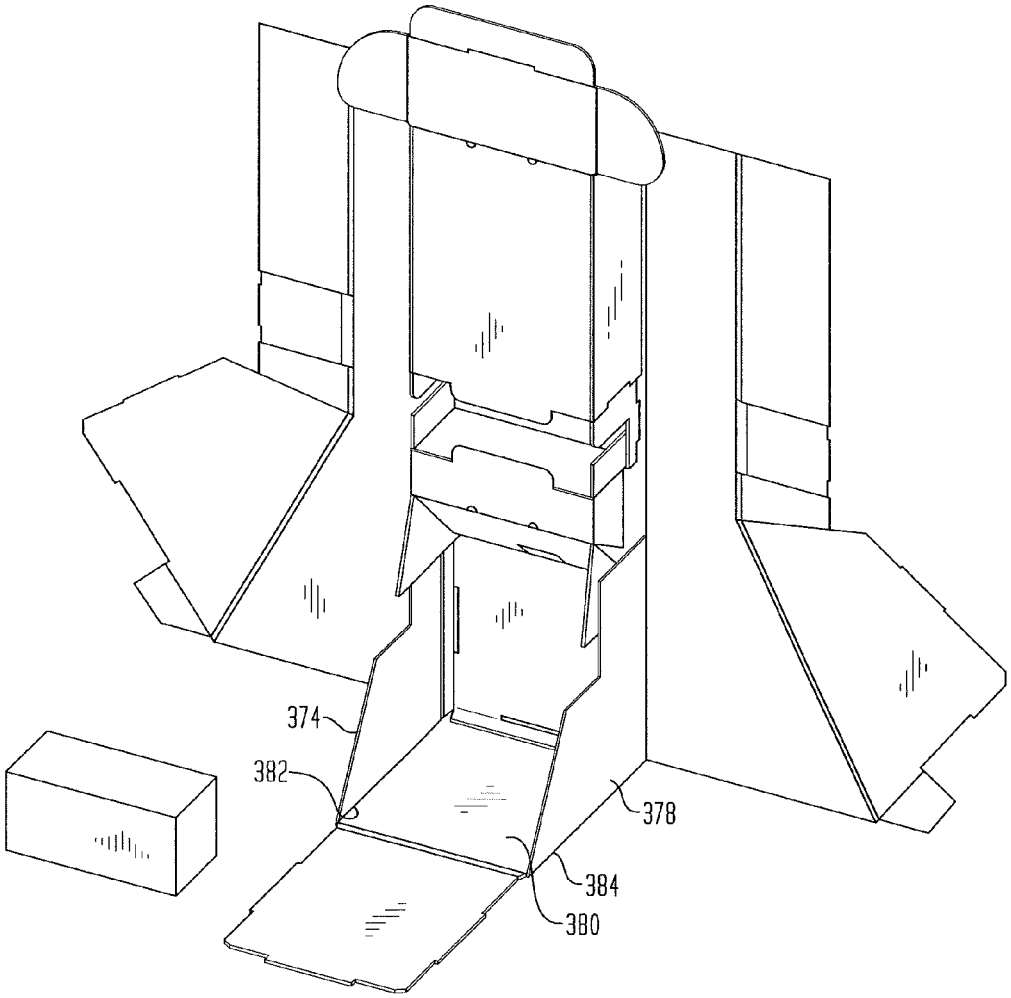

Referring to FIG. 19, panel 374 is folded along fold line 382 toward panel 380 until panel 374 is oriented substantially orthogonal to panel 380 to form a sidewall of bottom base portion 12. Panel 378 is folded along fold line 384 toward panel 380 until panel 378 is oriented substantially orthogonal to panel 380 to form another sidewall of bottom base portion 12.

Figure 20:
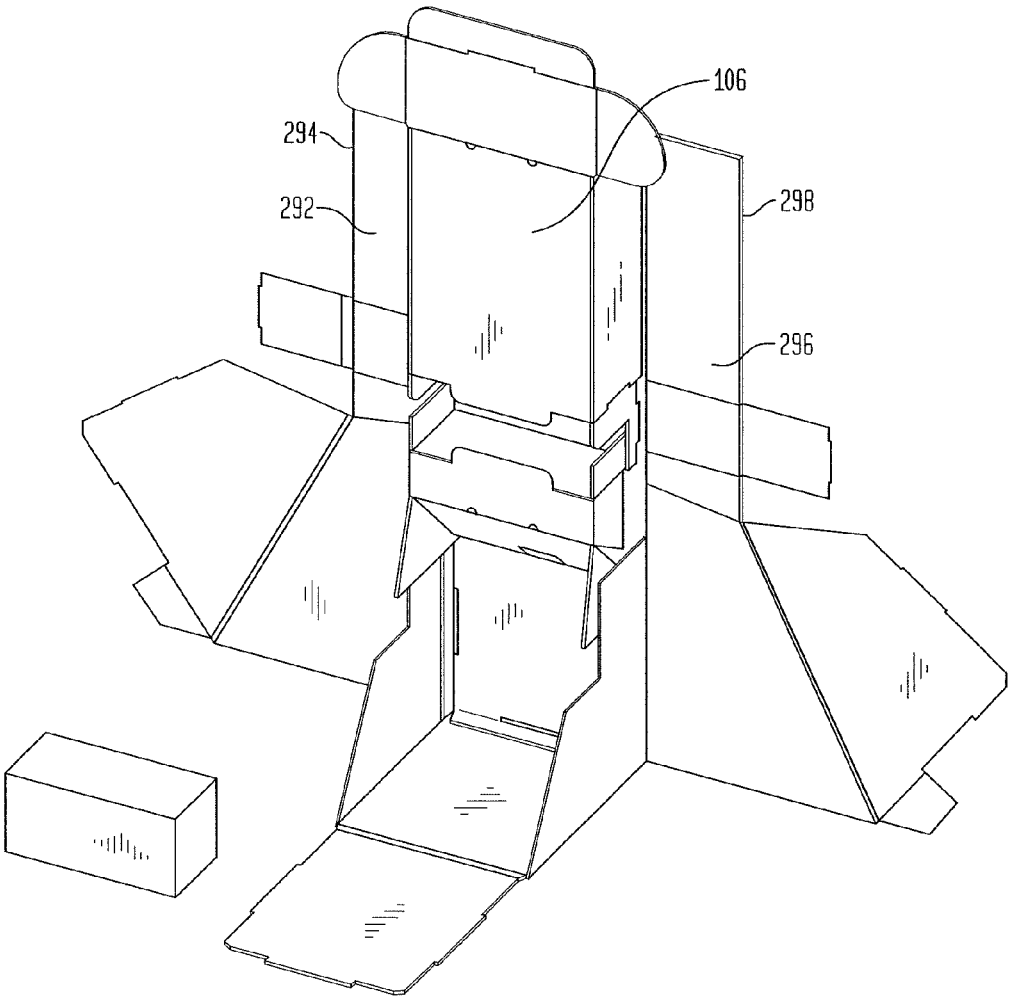

With reference to FIG. 20, panel 292 is folded along fold line 294 toward main central panel 106. Although not explicitly shown in FIG. 20, panel 292 is positioned over the upper portion 286*a* of panel 286. Panel 296 is folded along fold line 298 toward main central panel 106. While not explicitly shown in FIG. 20, panel 296 is positioned over the upper portion 288*a* of panel 288.

Figure 21:
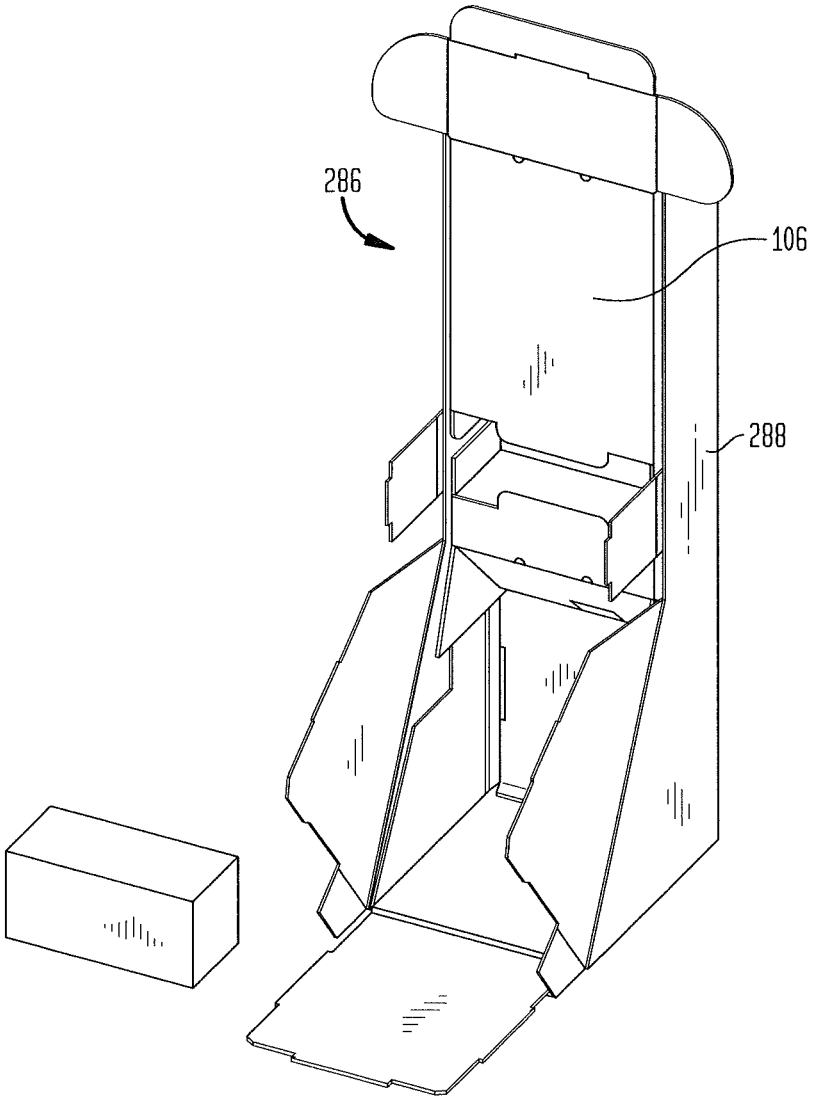

As seen in FIG. 21, panel 286 is folded toward main central panel 106 to form a sidewall of packaging assembly 10. Similarly, panel 288 is folded toward main central panel 106 to form a sidewall of packaging assembly 10.

Figure 22:
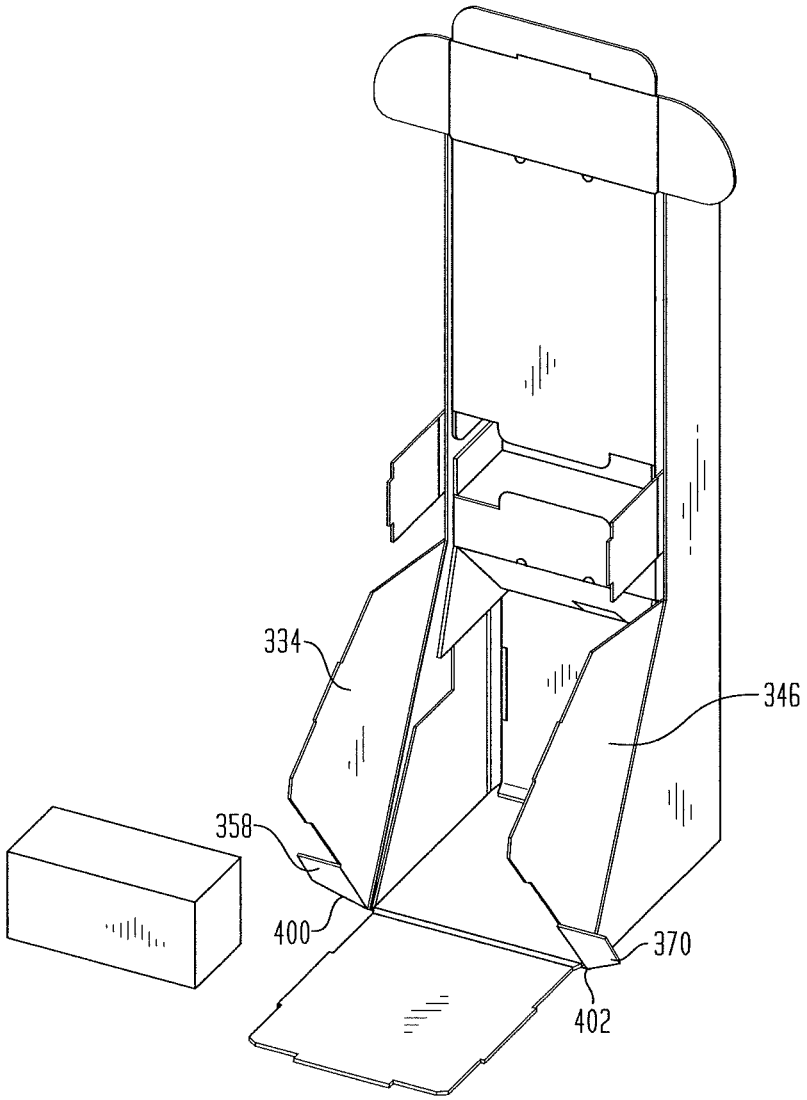

As illustrated in FIG. 22, flap 358 is folded along fold line 400 away from panel 334 until flap 358 is oriented substantially perpendicular to panel 334. Flap 370 is folded along fold line 402 away from panel 346 until flap 370 is oriented substantially perpendicular to panel 346.

Figure 23:
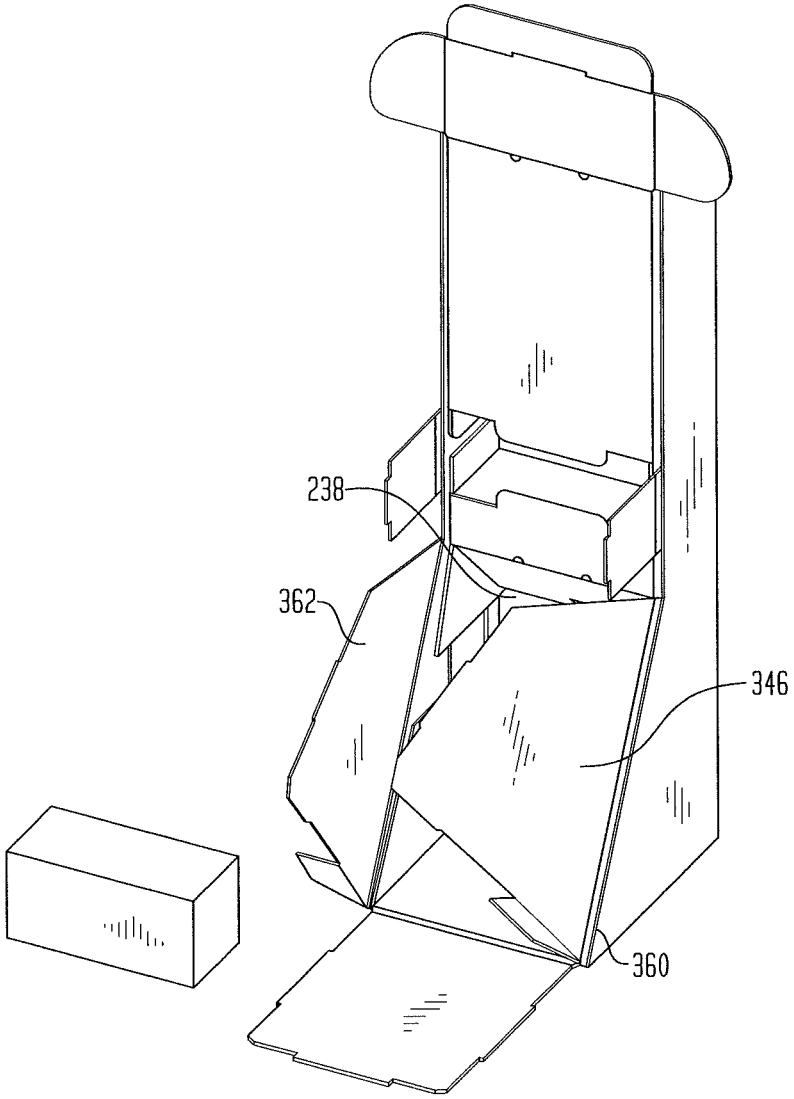
Figure 24:
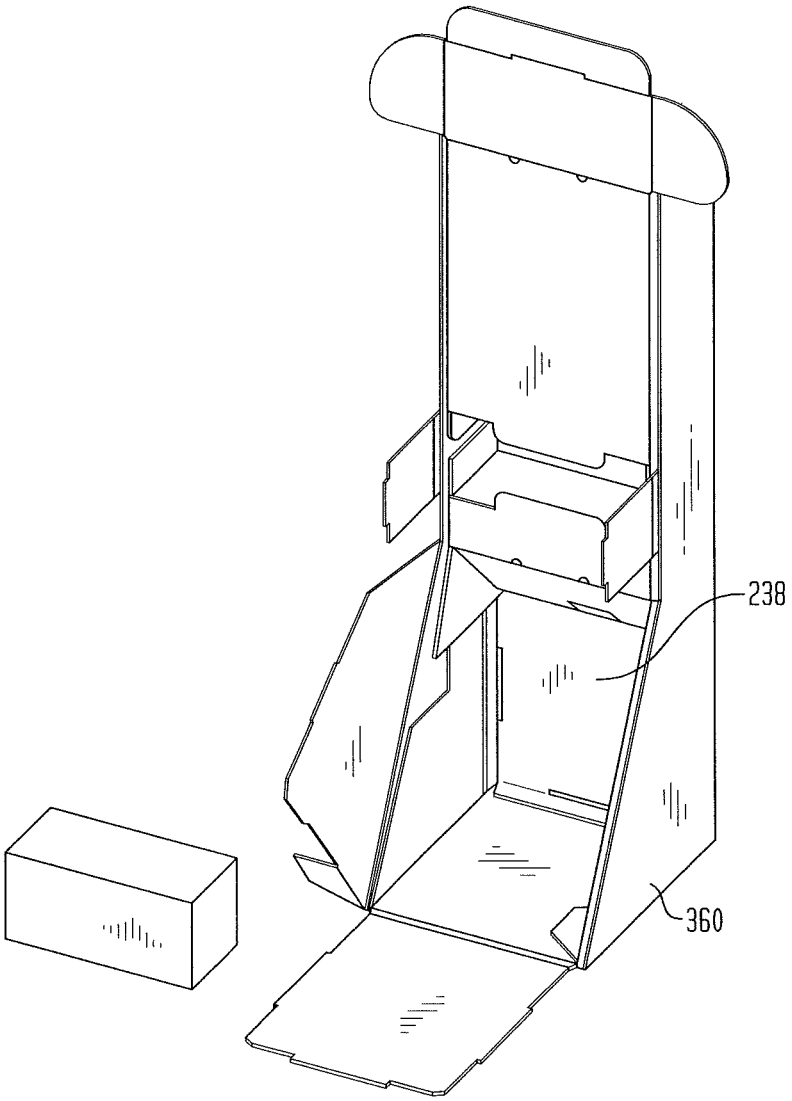
Figure 25:
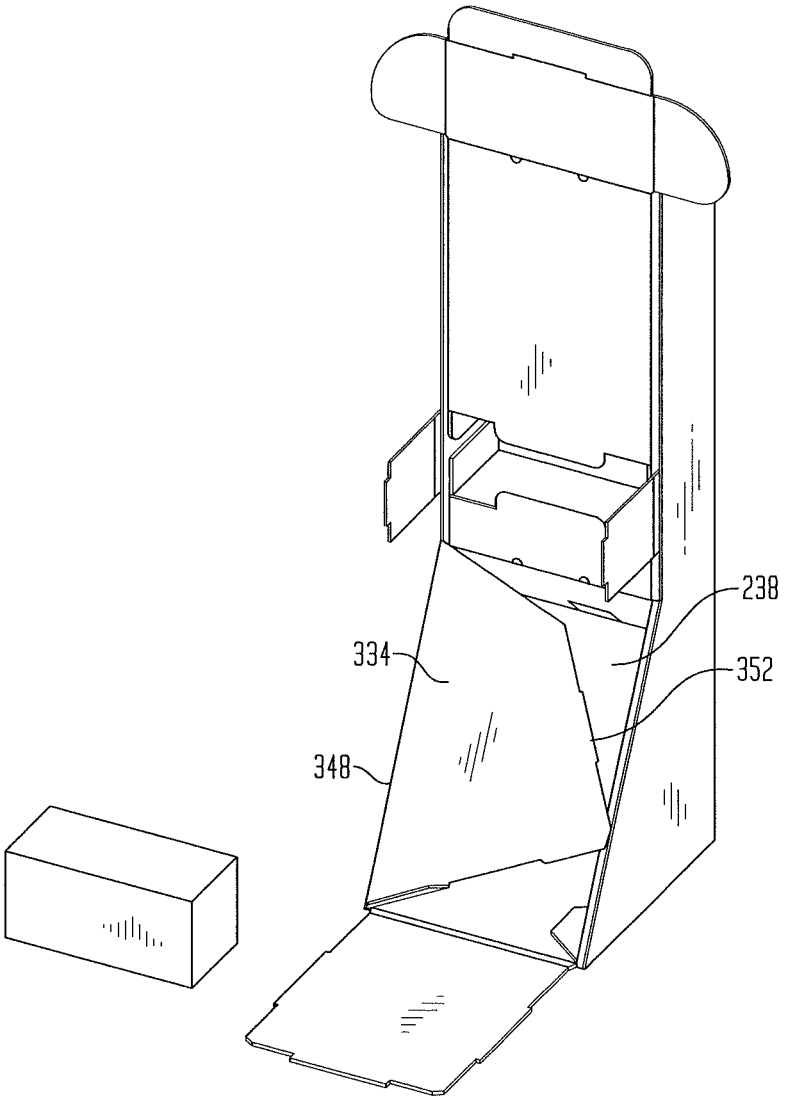
Figure 26:
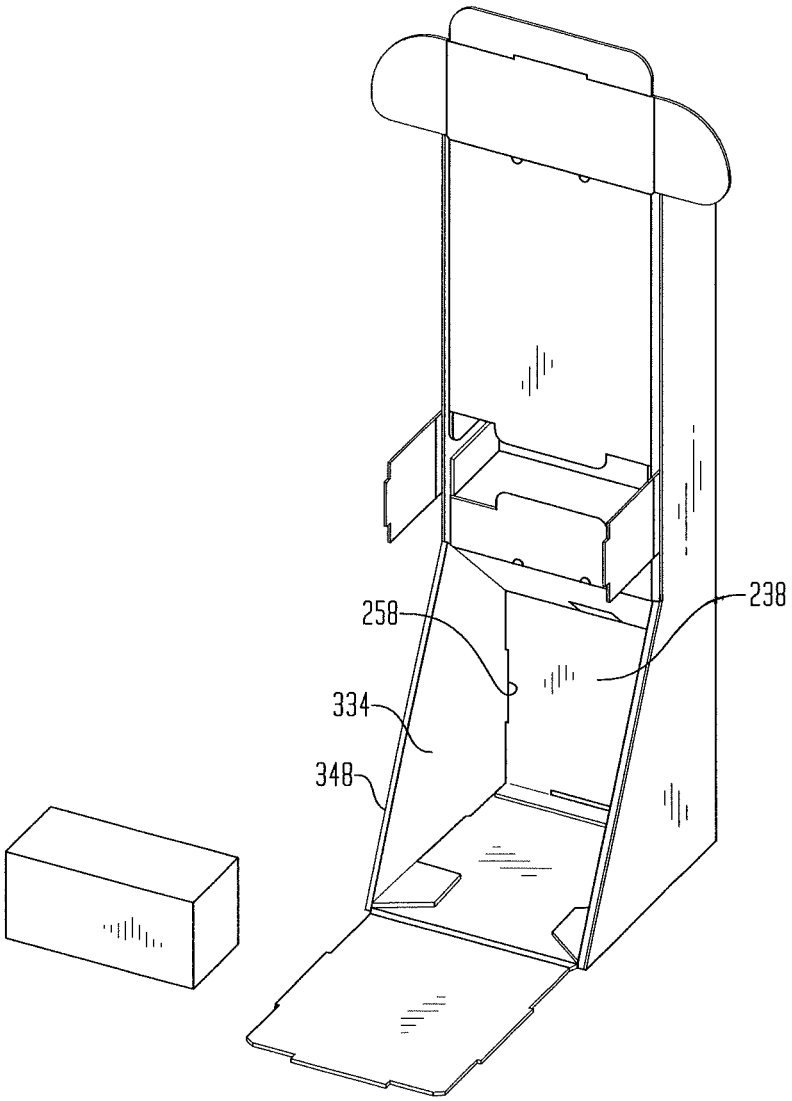

With reference to FIGS. 23 and 24, panel 346 is folded along fold line 360 toward panel 238 until first tab 362 is securely inserted in cutout 262 to connect the first blank 102 to the second blank 104 (see also FIG. 8). As shown in FIGS. 25 and 26, panel 344 is folded along fold line 348 toward panel 238 until first tab 352 is securely inserted inside cutout 258 to connect the first blank 102 to the second blank 104.

Figure 27:
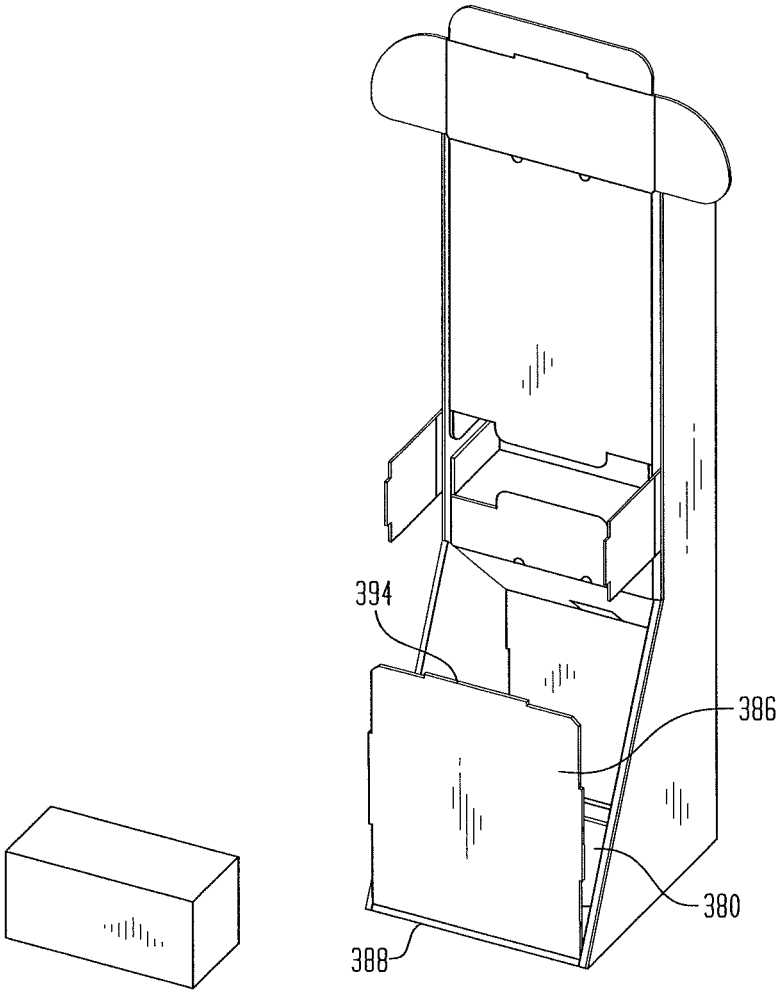
Figure 28:
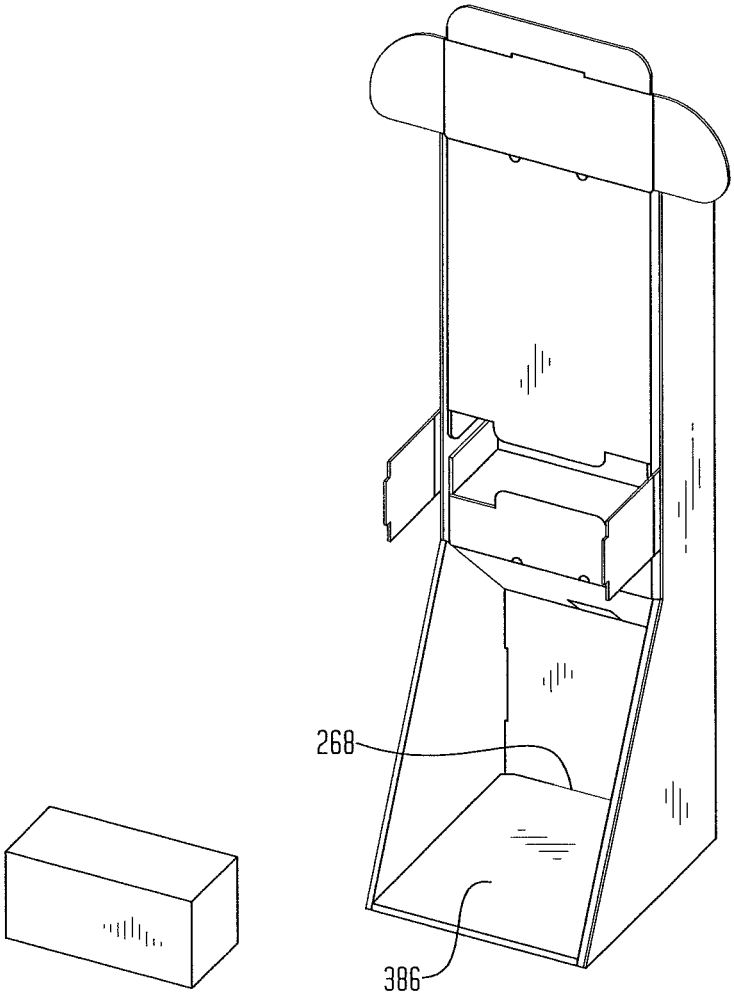

As illustrated in FIGS. 27 and 28, panel 386 is folded along fold line 388 toward panel 380 until tab 394 is securely inserted in cutout 268 to form the bottom wall of the bottom base portion 12. As shown in FIG. 29, panel 106 is then pivoted along fold line 136 away from panel 270 to create a space to insert accessory 214 in hollow compartment 18.

Figure 30:
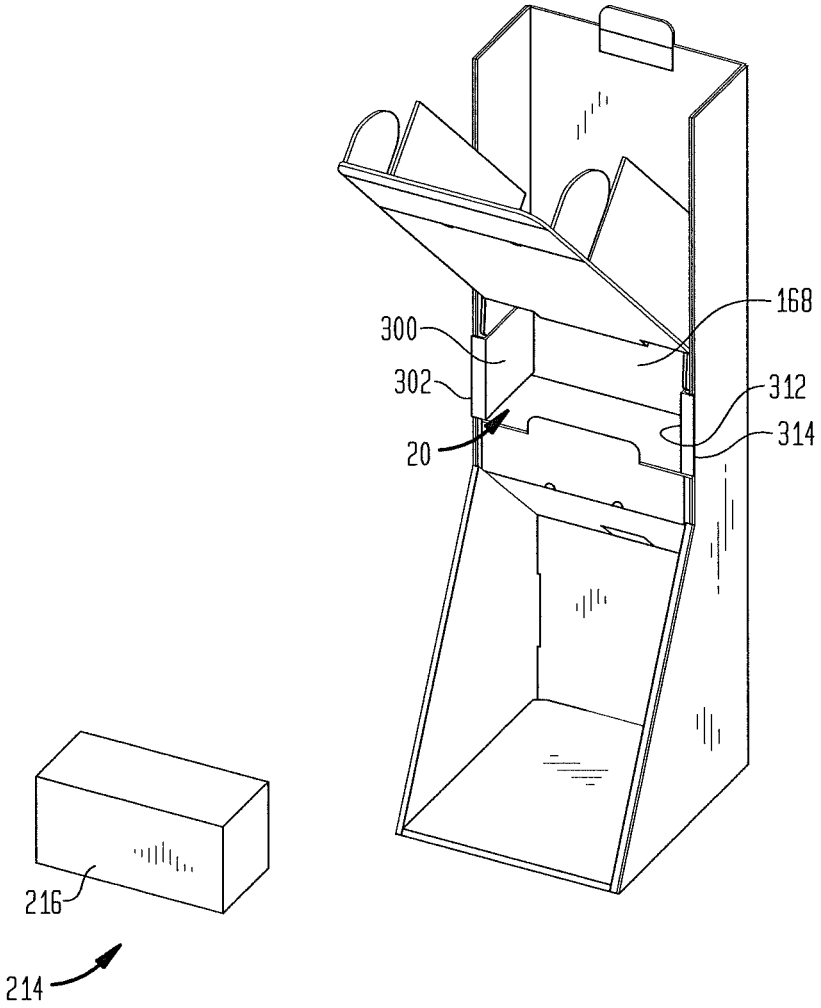
Figure 31:
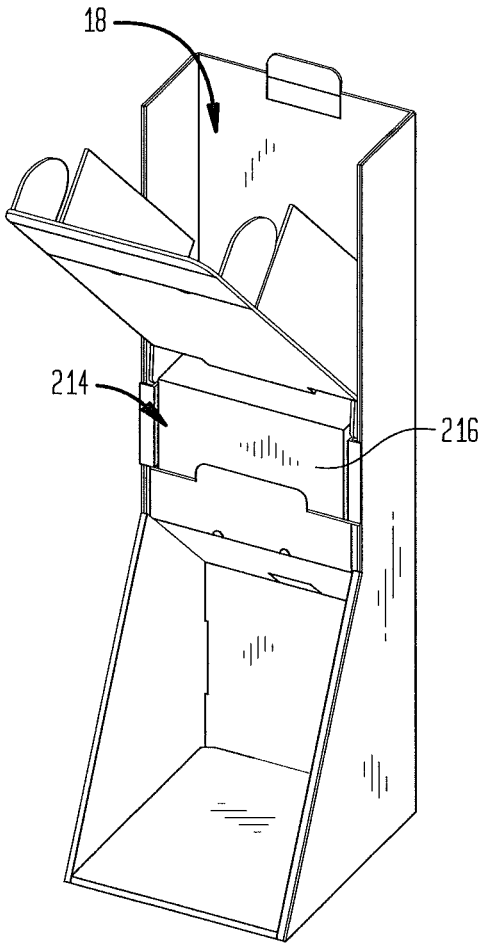

With reference to FIG. 30, panel 300 is then folded along fold line 302 toward panel 168 until tab 306 is securely positioned in cutout 162 (see FIGS. 8 and 9) to create sidewalls around opening 20 and secure the first blank 102 to the second blank 104. In addition, panel 312 is folded along fold line 314 toward panel 168 until tap 318 is securely inserted in cutout 166 (see FIGS. 8 and 97.) As seen in FIG. 31, the accessory 214 then is inserted in hollow compartment 18. Accessory 214 may be contained in package 216.

Figure 32:
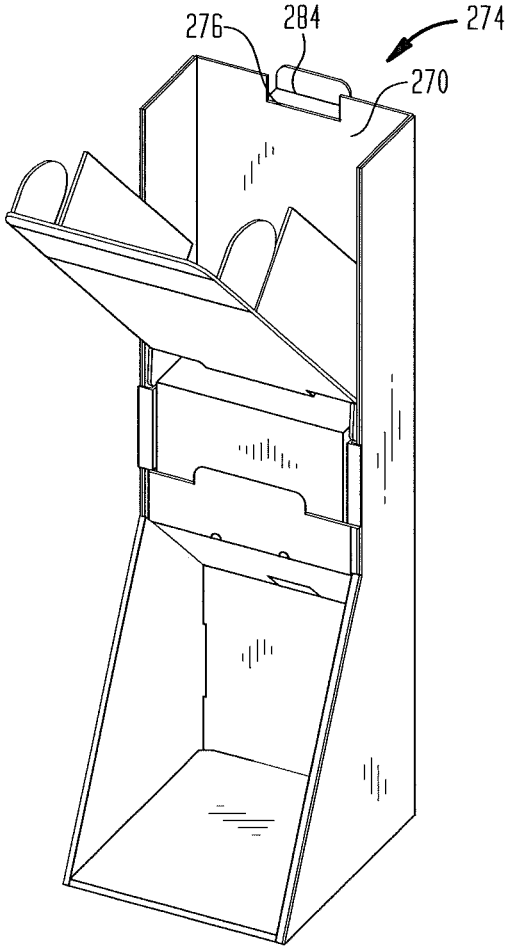

Subsequently, the tab 274 is folded along fold lines 276 and 284 and moved away from panel 270, as seen in FIG. 32. Panel 106 is then pivoted toward panel 270 by folding it along fold line 133, as shown in FIG. 33, to partially close hollow compartment 18.

Figure 33:
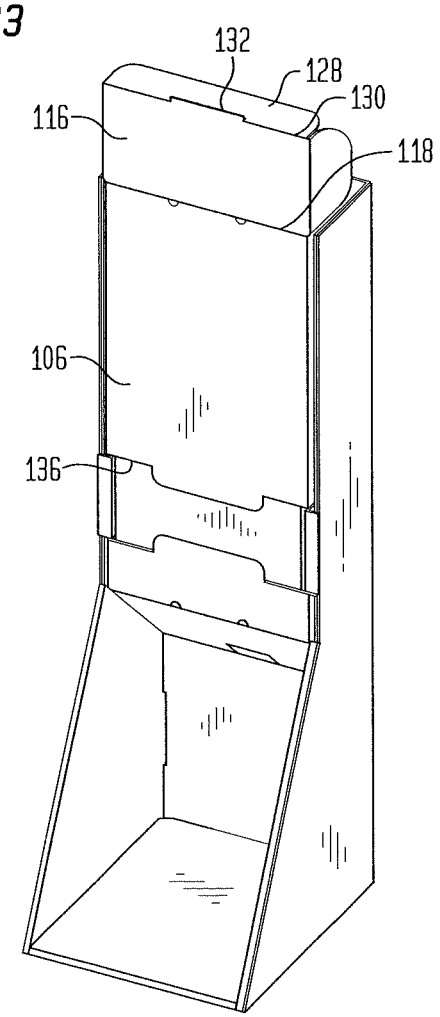
Figure 34:
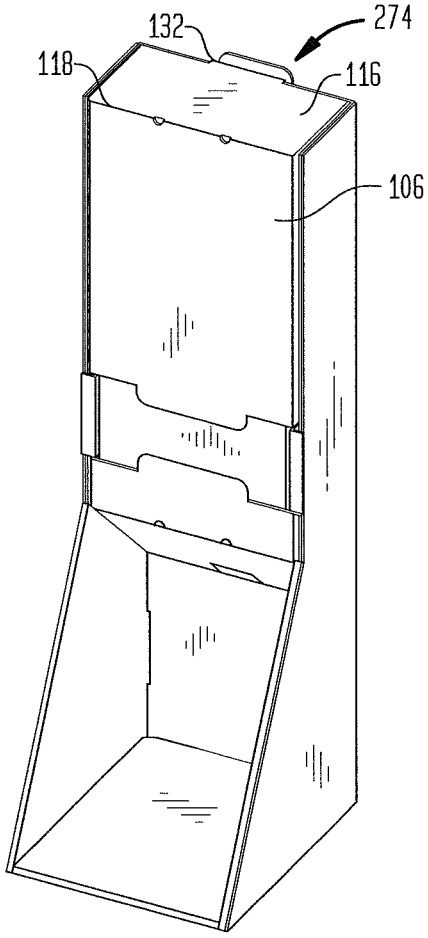
Figure 35:
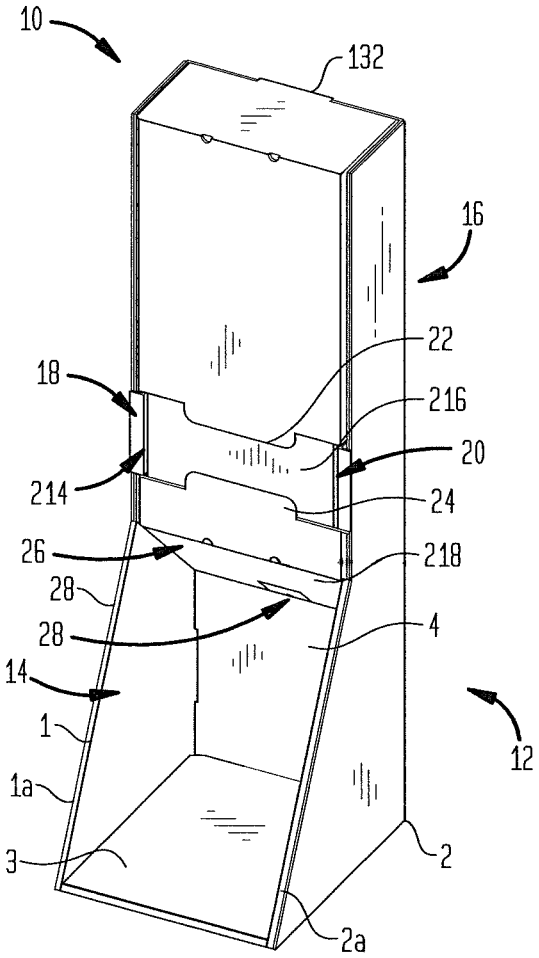

As seen in FIGS. 33-35, tab 128 is folded along fold line 130 until tab 128 is oriented substantially orthogonal to panel 116. Then, panel 116 is folded along fold line 118 until panel 116 is oriented substantially orthogonal to panel 106 and tab 128 is positioned within hollow compartment 18, as seen in FIG. 34. When panel 116 is folded along fold line 118, the upper portion 16 is closed. A portion of tab 274 is finally inserted in cutout 132, as shown in FIG. 35, to secure panel 116 to tab 274.

FIG. 35 shows packaging assembly 10 in the assembled condition. In the assembled condition, packaging assembly 10 generally includes a bottom base portion 12 with an open compartment 12, a hollow upper portion 16 with a hollow compartment 18, and a hollow cord compartment 26 disposed between the bottom base portion 12 and the hollow upper portion 16. The bottom base portion 12 includes first and second sidewalls 1 and 2 oriented substantially parallel to each other. The open compartment 14 is positioned between the first and second sidewalls 1 and 2. The bottom base portion 12 further includes a bottom wall 3 connected to the first and second sidewalls 1 and 2. The bottom wall 3 may have a substantially planar configuration and is dimensioned to receive (and adapted to support) the base 202 of light fixture 200. Each of the first and second sidewalls may include a respective front edge 1*a* and 2*a* oriented at an oblique angle relative to bottom wall 3. The bottom base portion 12 may additionally include a rear wall 4 connected to the first and second sidewalls 1 and 2.

As discussed above, the packaging assembly 10 may include a cord compartment 26 dimensioned to receive an electrical cord of light fixture 200. The panel 218 partially forming cord compartment 26 may be oriented at an oblique angle relative to the rear wall 4. As discussed above, packaging assembly 10 may include a hole 28 leading to the cord compartment 26. The hole 28 is in communication with the open compartment 14 of the bottom base portion 12 and is dimensioned to receive at least a portion of the electrical cord of light fixture 200.

The hollow upper portion 16 of packaging assembly 10 may include an opening 20 leading to the hollow compartment 18. The opening 20 is dimensioned to allow the accessory 214 or package 216 to be visible from outside of the package assembly 10. Moreover, locking tabs 22 and 24 are disposed over the accessory 214 or package 216 to inhibit removal of the accessory 214 or package 216 from hollow compartment 18 through opening 20. Locking tabs 22 and 24 may be protruding toward each other and disposed over opening 20 in a common plane.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with other of the described embodiments.

The invention claimed is:

1. A package assembly for a light fixture, comprising:

a light fixture including a light socket, a base, and a body interconnecting the light socket and the base;

a bottom base portion having an open compartment, at least one side of the open compartment not being fully enclosed, the open compartment receiving a base of the light fixture, wherein the light fixture is larger than the open compartment;

an upper portion coupled to the bottom base portion, the upper portion including a hollow compartment storing at least one of a light bulb for the light fixture or a package containing a light bulb for the light fixture, each side of the hollow compartment being at least partially enclosed; and an opening leading to the hollow compartment, the opening being dimensioned to allow at least one of the light bulb or the package containing the light bulb to be visible from outside of the upper portion, wherein the upper portion includes at least two locking tabs protruding toward the opening, the at least two locking tabs being adapted to inhibit removal of the at least one of the light bulb or the package containing the light bulb through the opening, and wherein the open compartment of the bottom base portion is dimensioned to receive the base of the light fixture without a substantial portion of the light fixture occupying the hollow compartment of the upper portion.

2. The package assembly according to claim 1, further comprising an opening leading to the hollow compartment and dimensioned to allow at least one of the light bulb or a package containing the light bulb to be visible from outside of the upper portion.

3. The packaging assembly according to claim 1, wherein the bottom base portion includes first and second sidewalls oriented substantially parallel to each other, and the open compartment is positioned between the first and second sidewalls.

4. The packaging assembly according to claim 3, wherein the bottom base portion includes a bottom wall connected to the first and second sidewalls and oriented substantially orthogonal to the first and second side walls, the bottom wall being dimensioned and adapted to support the base of the light fixture, the first and second sidewalls having a front edge arranged at an angle relative to the bottom wall.

5. The packaging assembly according to claim 4, wherein the bottom base portion includes a rear wall extending substantially orthogonal from the bottom wall and connected to the first and second sidewalls.

6. The packaging assembly according to claim 1, further comprising a cord compartment dimensioned to receive an electrical cord of the light fixture, the cord compartment being disposed between the bottom base portion and the upper portion.

7. The packaging assembly according to claim 6, further comprising a hole leading to the cord compartment and dimensioned to receive at least a portion of the electrical cord, the hole being in communication with the open compartment of the bottom base portion.

8. The packaging assembly according to claim 1, wherein the at least two locking tabs are protruding toward each other in a common plane.

9. A plurality of blanks adapted to form a display package for a light fixture, comprising:

a first blank having a plurality of first panels and a plurality of first fold lines; and a second blank having a plurality of second panels and a plurality of second fold lines;

wherein the first and second panels are arrangable by folding the first and second panels about appropriate first and second fold lines to form a package, comprising:

a bottom base portion having an open compartment, at least one side of the open compartment not being fully enclosed, the open compartment being dimensioned to receive a base of a light fixture, the light fixture being larger than the open compartment; and an upper portion coupled to the bottom base portion, the upper portion including a hollow compartment, each side of the hollow compartment being at least partially enclosed, dimensioned to receive an accessory for the light fixture, wherein at least two of the first panels are spaced apart from each other so as to form an opening leading to the hollow compartment, and include tabs protruding therefrom and disposed over the opening.

10. The plurality of blanks according to claim 9, wherein at least one of the plurality of first panels includes a tab protruding therefrom, and at least one of the second panels includes has a cutout, the tab being dimensioned to be securely inserted in the cutout to connect the first blank and the second blank.

11. The plurality of blanks according to claim 9, wherein at least three of the first panels are adapted to form a cord compartment dimensioned to receive an electrical cord of the light fixture.

* * * * *